US006311843B1

(12) United States Patent
Smith et al.

(10) Patent No.: US 6,311,843 B1
(45) Date of Patent: Nov. 6, 2001

(54) PACKAGING BOXES AND COMPONENTS WITH INTERNAL RESILIENT ELEMENTS

(75) Inventors: Jeffrey A. Smith, Clark; Richard N. Beneroff, Harding Township; Eric Kim, Secaucus, all of NJ (US); Brian M. Carli, Penfield, NY (US)

(73) Assignee: Motion Design, Inc., Linden, NJ (US)

( * ) Notice: Subject to any disclaimer, the term of this patent is extended or adjusted under 35 U.S.C. 154(b) by 0 days.

(21) Appl. No.: 09/410,782

(22) Filed: Oct. 1, 1999

(51) Int. Cl.[7] ..... B65D 81/02
(52) U.S. Cl. ..... 206/583; 206/466
(58) Field of Search ..... 206/320, 305, 206/497, 576, 521, 523, 583, 591, 594, 466

(56) References Cited

U.S. PATENT DOCUMENTS

| | | | |
|---|---|---|---|
| Re. 30,098 | | 9/1979 | Titchenal et al. . |
| Re. 36,412 | * | 11/1999 | Jones ..... 206/583 |
| 457,390 | | 8/1891 | Weeks . |
| 1,730,437 | | 10/1929 | Sanderson . |
| 1,985,075 | | 12/1934 | Bird . |
| 2,032,386 | | 3/1936 | Wood . |
| 2,114,422 | | 4/1938 | Guyer . |
| 2,837,208 | | 6/1958 | Lingenfelter . |
| 2,956,672 | | 10/1960 | Kirkpatrick . |
| 3,089,590 | | 5/1963 | Mell . |
| 3,322,263 | | 5/1967 | Gulliver . |
| 3,456,780 | | 7/1969 | Forman . |
| 3,507,383 | | 4/1970 | Rorer . |
| 3,544,007 | | 12/1970 | Bordman . |
| 3,600,872 | | 8/1971 | Sharpnack, Jr. . |
| 3,627,116 | | 12/1971 | Cooper . |
| 3,669,337 | | 6/1972 | Struble . |
| 3,750,872 | | 8/1973 | Bobb . |
| 3,752,301 | | 8/1973 | Bluemel . |
| 3,796,307 | | 3/1974 | McKinney . |
| 3,853,220 | | 12/1974 | Luray . |

(List continued on next page.)

FOREIGN PATENT DOCUMENTS

| | | |
|---|---|---|
| 638038 | 3/1962 | (CA) . |
| 670168 | 9/1963 | (CA) . |
| 691904 | 8/1964 | (CA) . |
| 0969457 | 6/1958 | (DE) . |
| 2564068 | 11/1985 | (FR) . |
| 2771380 | 5/1999 | (FR) . |
| 237322 | 7/1925 | (GB) . |
| 904628 | 8/1962 | (GB) . |
| 1425746 | 2/1976 | (GB) . |
| 1426331 | 2/1976 | (GB) . |
| 1561596 | 2/1980 | (GB) . |
| 2239854 | 7/1991 | (GB) . |
| 49-59982 | 5/1974 | (JP) . |
| 49-77087 | 7/1974 | (JP) . |
| 50-88376 | 7/1975 | (JP) . |
| 50-102778 | 8/1975 | (JP) . |
| 50-107583 | 9/1975 | (JP) . |
| 57-177969 | 11/1982 | (JP) . |
| 3-100158 | 10/1991 | (JP) . |
| 0022483 | 9/1930 | (NL) . |
| 0360646 | 4/1962 | (SE) . |
| 827346 | 5/1981 | (SU) . |
| 86/02336 | 4/1986 | (WO) . |
| 98/18694 | 5/1998 | (WO) . |

* cited by examiner

*Primary Examiner*—Luan K. Bui
(74) *Attorney, Agent, or Firm*—Kenyon & Kenyon

(57) ABSTRACT

A series of packaging designs are provided, comprising relatively rigid sheets surrounded by a resilient element, such as a sleeve or tube. The relatively rigid sheets may have appropriately configured end panels, side panels, fold lines, divider panels, or other desired features. Products may be secured inside the sleeve, against the relatively rigid sheet, or against the outside of the sleeve.

5 Claims, 22 Drawing Sheets

U.S. PATENT DOCUMENTS

| | | | |
|---|---|---|---|
| 3,905,474 | 9/1975 | Haibara . | |
| 3,946,870 | 3/1976 | Gajer et al. . | |
| 4,030,603 | 6/1977 | Angell . | |
| 4,087,003 | 5/1978 | Adamek . | |
| 4,180,165 | 12/1979 | Kuchenbecker . | |
| 4,285,432 | 8/1981 | de Villers et al. . | |
| 4,306,653 | 12/1981 | Fales . | |
| 4,307,804 | 12/1981 | Benham . | |
| 4,328,896 | 5/1982 | Behne . | |
| 4,488,466 | 12/1984 | Jones . | |
| 4,606,459 | 8/1986 | Luray . | |
| 4,757,900 | 7/1988 | Misset et al. . | |
| 4,852,743 | 8/1989 | Ridgeway . | |
| 4,923,065 | 5/1990 | Ridgeway . | |
| 5,044,495 | 9/1991 | Wyslotsky . | |
| 5,056,665 | 10/1991 | Boecker et al. . | |
| 5,071,009 | 12/1991 | Ridgeway . | |
| 5,086,925 | 2/1992 | Coalier et al. . | |
| 5,108,803 | 4/1992 | Kondo et al. . | |
| 5,129,518 | 7/1992 | Tanaka et al. . | |
| 5,218,510 | 6/1993 | Bradford . | |
| 5,226,531 | 7/1993 | Garwood . | |
| 5,226,542 | 7/1993 | Boecker et al. . | |
| 5,240,111 | 8/1993 | Yamashita et al. . | |
| 5,251,760 | 10/1993 | Smith et al. . | |
| 5,259,507 | 11/1993 | Smith . | |
| 5,287,968 | 2/1994 | Ridgeway . | |
| 5,323,896 | 6/1994 | Jones . | |
| 5,388,701 | 2/1995 | Ridgeway . | |
| 5,579,917 | 12/1996 | Lofgren et al. . | |
| 5,669,506 | 9/1997 | Lofgren et al. . | |
| 5,676,245 | 10/1997 | Jones . | |
| 5,678,695 | 10/1997 | Ridgeway et al. . | |
| 5,694,744 | 12/1997 | Jones . | |
| 5,701,999 * | 12/1997 | Phillips, II et al. | 206/320 |
| 5,722,541 | 3/1998 | Lofgren et al. . | |
| 5,934,473 * | 8/1999 | Belshe | 206/583 |

PACKAGING BOXES AND COMPONENTS WITH INTERNAL RESILIENT ELEMENTS

BACKGROUND OF THE INVENTION

The invention relates to packaging in general, and, more particularly, to packaging boxes and components for retaining items in a secure manner.

Various packaging boxes are known, including boxes equipped for shipping items in a secure manner. For instance, sensitive items are often shipped in boxes with the items supported on blocks or on specially molded foamed polyurethane, or spaced from the side panels of the box by cardboard inserts, foamed polyurethane pellets or beads, or the so-called bubble-wrap sheets. These protective measures suppress the transmission to the items of impacts, shocks, vibrations and/or other forces to which the box itself may be subjected, but they sometimes are bulky, costly, difficult to handle, environmentally undesirable, and/or are non-compliant or do not conform to the items being shipped.

Some packaging components utilize resilient film to retain items being shipped in a secure manner. For example, inserts comprising cardboard frames with plastic film stretched over the frame have been used, with the item being secured between two such inserts that oppose each other.

The assignee of this application has rights under several U.S. patents relating to packaging. U.S. Pat. No. 5,323,896 to Jones shows an article packaging kit comprising an insert having a flat, corrugated cardboard sheet surrounded by a plastic sleeve or tube. The sheet is foldable to allow the sleeve or tube to be bloused up to accommodate an item. Returning the sheet to a flat position causes the sleeve to be tensioned about the item. U.S. Pat. No. 5,676,245, also to Jones, shows a similar arrangement.

The entire disclosures of U.S. Pat. Nos. 5,323,896 and 5,676,245 are hereby expressly incorporated herein by reference.

OBJECT AND SUMMARY OF THE INVENTION

An object of the invention is to provide alternative means for securing items being shipped in packaging boxes.

Another object of the invention is to provide alternative packaging designs utilizing relatively rigid sheets and resilient elements.

Other objects of the invention include providing packaging boxes and/or components, e.g. inserts, that have one or more of the following capabilities: (1) to accommodate a wide range of sizes and shapes of items; (2) to space items from the bottom, sides and/or top of the outer box, including, if desired, by spacing panels that provide some ability to absorb impacts; (3) to provide for improved securing of the items; and/or (4) to allow for the securing of multiple items.

In accordance with certain embodiments of the invention, a packaging insert is provided comprising a relatively rigid sheet and a resilient element. The resilient element may be a resilient sleeve or tube that surrounds the relatively rigid sheet. The relatively rigid sheet may be provided with a base panel having a plurality of fold lines that permit the base panel to be folded to accommodate items of various shapes and sizes. Additionally or alternatively, the relatively rigid sheet may be provided with one or more side panels that can be used to provide a greater width for the sheet in a flat condition. In this manner, the relatively rigid sheet accommodates a larger sleeve, making the insert capable of holding larger items. In use, the side panel (or panels) can be folded under the base panel so that the width of the base of the insert is significantly smaller than one-half the circumference of the tube.

Other variations of an insert are within the scope of the invention. For example, the relatively rigid sheet may have end panels that have integral leg portions that provide support against the bottom of a box into which the insert is placed. The end panels may be foldable to provide for cinching of the sleeve for better securement of the item or items. Additionally or alternatively, the end panels may be foldable to provide extra support for the insert against the bottom, sides and/or top of the box. The end panels may also provide internal support for the box panels to help prevent crushing of the box itself.

The insert may accommodate one or a plurality of items. For example, the insert may be provided with a divider or may have fold lines positioned in a way to provide separate places or compartments within the insert for separate items.

The insert may be designed for accommodating the item or items on the inside of the sleeve. In this manner, the items are held securely against the relatively rigid sheet by the sleeve. Alternatively, the insert may be designed so that the item is secured against the outside of the sleeve. One example of a use for such a design is as an edge protector.

More than one insert may be provided for use in securing an item or items. For example, two separate, and possibly interlocking, inserts can be provided, with an item to be held between the resilient elements of the two opposing inserts. In embodiments where the resilient element is a sleeve, this is another arrangement in which the item is secured against the outside of the sleeve.

The insert (or inserts) may be separate from the box into which it is to be placed or may be joined to it.

The resilient element may be formed, for example, of a plastic film. Other suitable materials include fabrics, cellulose, rubbers, polymers, and any other material providing the desired pliability, elasticity, and/or flexibility. It may also have additional features, such as slits, holes, or punctures to allow the desired result with respect to the item or items to be secured. For example, a resilient element in the form of a mesh may be used to suspend an item, wherein slits or openings in the mesh permit the resilient element to support the item like a hammock.

In appropriate embodiments, the shape of the resilient element may be in a form other than a sleeve or tube, such as a sheet, pocket or any other suitable configuration.

In accordance with certain embodiments of the invention, the insert (and also the box, if the insert is attached to the box) may be constructed so that it may be shipped to the user in a substantially flat condition.

In accordance with some embodiments, the packaging insert (or box) may be reused and/or easily recycled. Thus, for example, the resilient element may be easily separable from the relatively rigid sheet to allow for separate recycling of the components.

DETAILED DESCRIPTION OF THE ILLUSTRATED EMBODIMENTS

Figure 1:
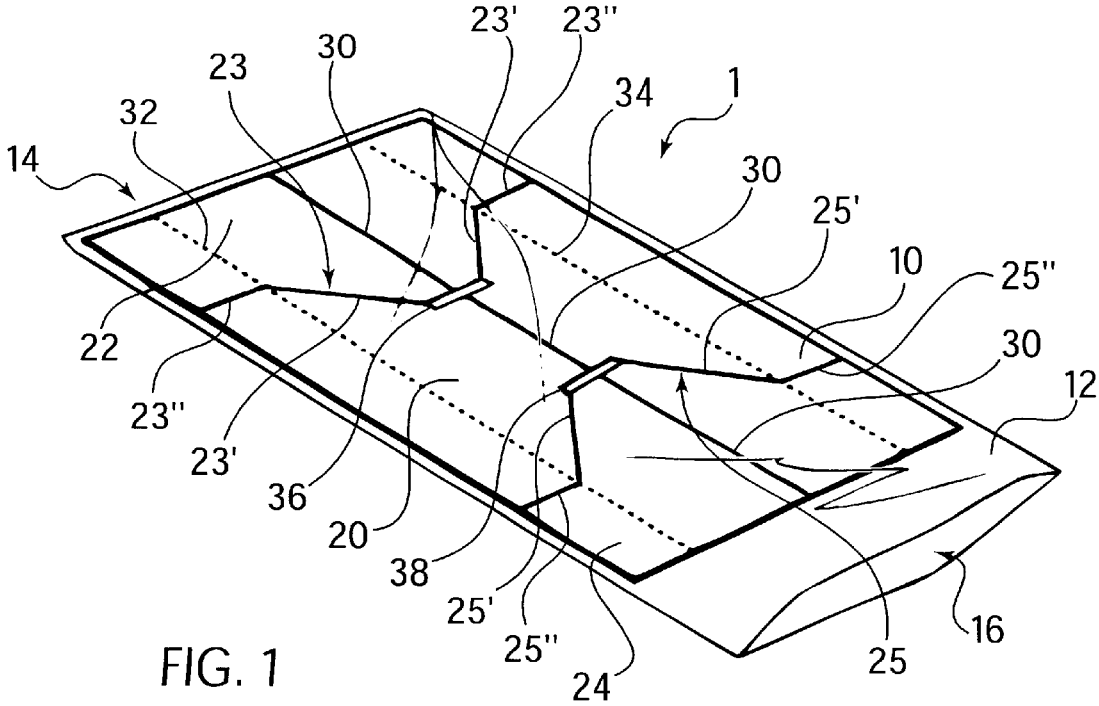
FIG. 1 shows an insert in accordance with a first embodiment of the invention.

FIG. 1 shows an insert 1 comprising a relatively rigid sheet 10 and a resilient element 12. The sheet 10 may be, for example, corrugated cardboard or any other suitable material. The resilient element 12 may be, for example, a plastic film or any other suitable material. In this illustrated embodiment, the resilient element 12 is in the form of a sleeve or tube.

The sheet 10 has a base panel 20 and two end panels 22 and 24. A central recess-forming fold line 30 and two lateral fold lines 32 and 34 extend across the length of the sheet 10, across the base panel 20 and the two end panels 22 and 24. The end panels are separated from the base panel by dividing lines 23 and 25, respectively. In the area between the two lateral fold lines 32 and 34, the dividing lines 23 and 25 are cut completely through the relatively rigid sheet 10 as cuts 23' and 25' to separate the end panels 22 and 24 from the base panel 20 in that area. In the areas on the outside of each of the lateral fold lines 32 and 34, i.e., from each lateral fold line 32, 34 to the respective edge of the sheet 10, the dividing lines 23 and 25 are simply score lines forming fold lines 23" and 25" permitting the end panels 22 and 24 to fold with respect to the base panel 20.

The sleeve 12 fits around the width of the sheet 10. In this embodiment, the circumference of the sleeve 12 is approximately twice as great as the width of the sheet 10, or slightly more or slightly less. In this manner, the sleeve 12 fits snugly around the sheet 10 when the sheet 10 is flat, as shown in FIG. 1.

To accommodate an item in the insert, the sheet 10 is folded at one or more of the fold lines 30, 32, 34. This blouses up the sleeve 12, to allow for an item to be placed in the sleeve 12, through either of the openings 14, 16 in the ends of the sleeve.

The number and placement of the fold lines 30, 32, 34 provide for great flexibility in accommodating a wide variety of items of varying shapes and sizes. Depending on how the sheet 10 is folded along these fold lines 30, 32, 34, the sleeve 12 may be opened to different configurations to accommodate different items.

Figure 2:
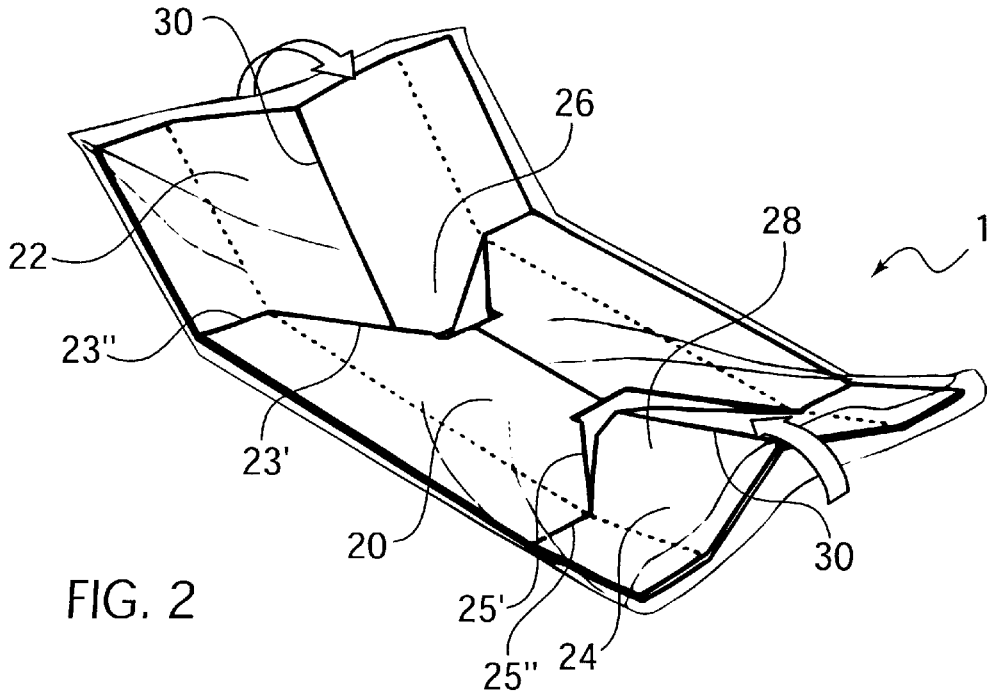
FIG. 2 shows a top perspective view of the insert of FIG. 1, with end panels being folded upward.

Once the product is placed within the sleeve 12, the base panel 20 is returned flat. This tensions the film 12 around the product, to hold the product securely against the sheet 10. Then, as shown in FIG. 2, the end panels 22 and 24 are folded upward. In this embodiment, the sleeve 12 is longer than the base panel 20 and extends all the way over both of the end panels 22 and 24. Because of this configuration, the folding of the end panels 22 and 24 further tensions the sleeve 12.

Cutouts 36 and 38 may be provided between the base panel 20 and the end panels 22 and 24, respectively. Because of the complete separation of the end panels 22 and 24 from the base panel 20 along the cuts 23' and 25' that form the central portions of the dividing lines 23 and 25, the end panels 22 and 24 have leg portions 26 and 28 that extend downward, below the base panel 20, when the end panels 22 and 24 are folded upward. When the insert 1 is placed inside a box, the leg portions 26 and 28 serve to space the base panel 20 from the bottom of the box. The portions of the end panels 22 and 24 that extend above the base panel 20 serve to space the base panel 20 from the top of the box.

Figure 3:
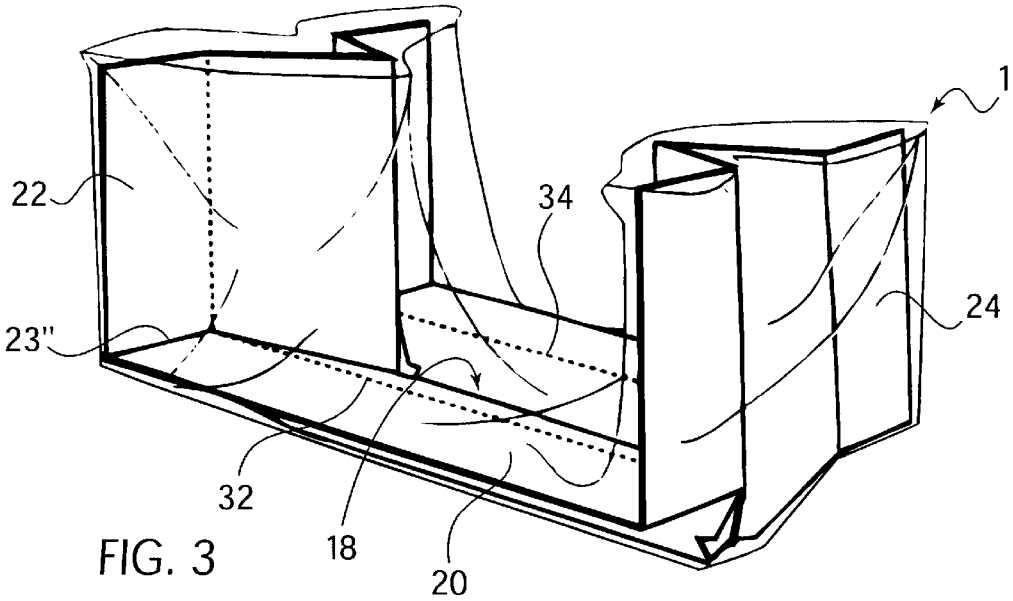
FIG. 3 shows a top perspective view of the insert of FIG. 1, with the end panels folded upward.

As shown in FIG. 3, the base panel 20 and end panels 22 and 24 may each be folded along fold lines 30, 32 and 34 when the insert is fully assembled. This folding of the end panels 22 and 24 provides spacers that serve to space the product from the sides of the box, thereby further protecting the product. The fold lines in the base panel 20 form a recess 18 that may help accommodate the product. For example, a round or other suitably shaped object may be held in place by fitting partially within the recess 18.

Figure 4:
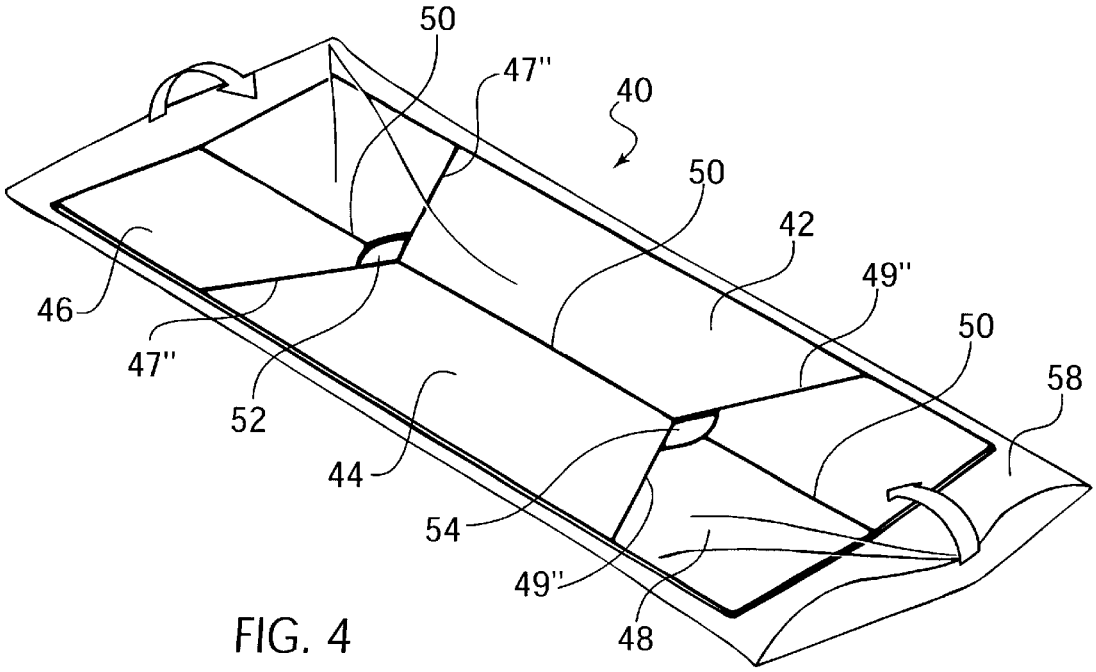
FIG. 4 shows an insert in accordance with another embodiment of the invention.
Figure 5:
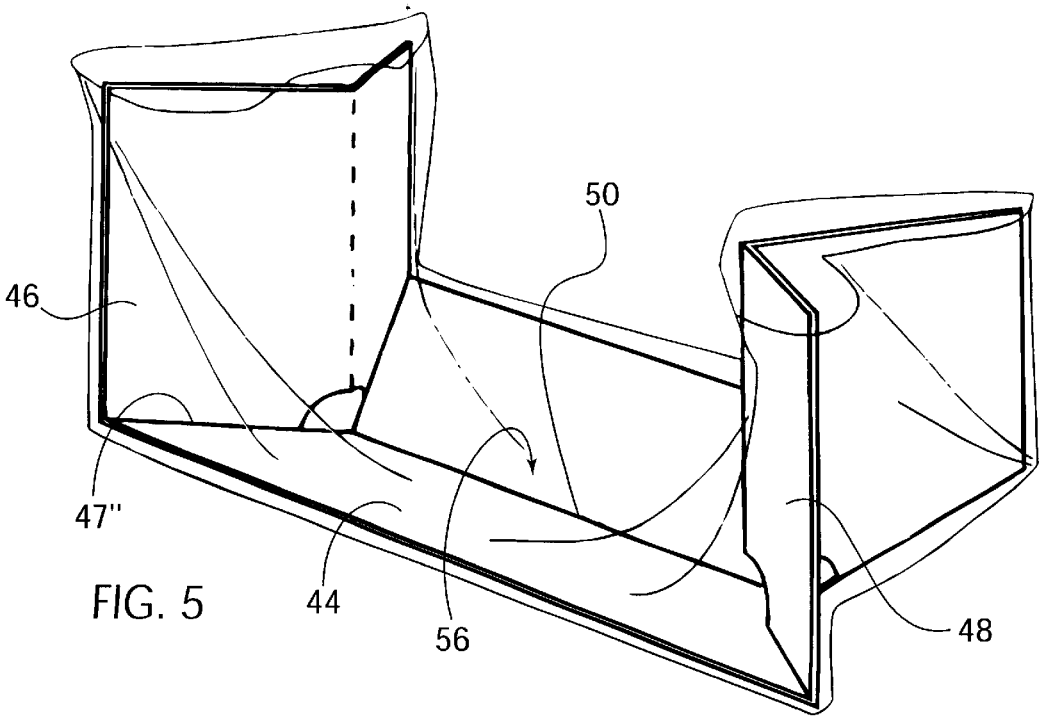
FIG. 5 shows a top perspective view of the insert of FIG. 4, with the end panels folded upward.

FIGS. 4 and 5 show another insert 40, similar to the insert 1. The insert comprises a relatively rigid sheet 42 and a resilient element in the form of a sleeve 58. The sheet 42 has a base panel 44, end panels 46 and 48, a recess-forming fold line 50, end panel fold lines 47" and 49", and cutouts 52 and 54. The use of one fold line 50 extending across the base panel 44 limits the range of products that can be accommodated. However, in this embodiment, a wider recess 56 is provided, which may be useful for certain objects. In this insert 40, there are no leg portions. The operation of insert 40 is otherwise similar to that of insert 1.

Figure 6:
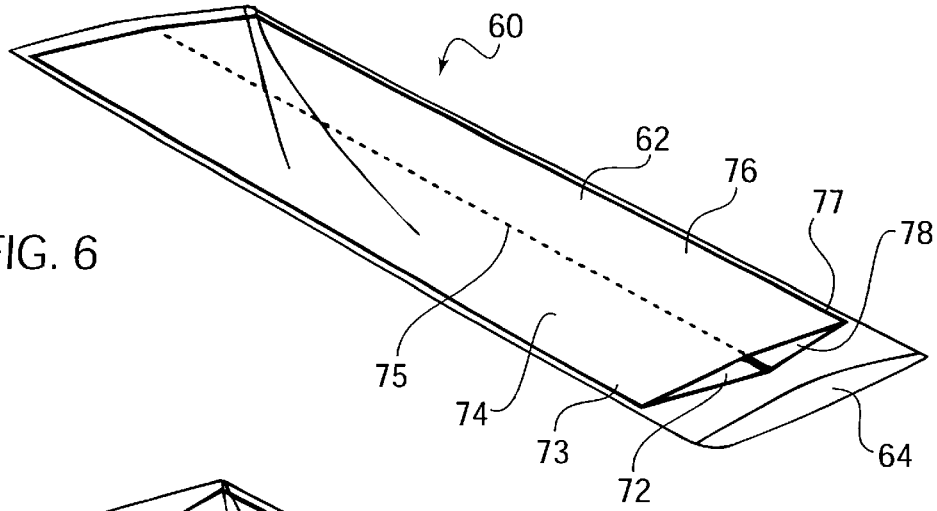
FIG. 6 shows an insert in accordance with another embodiment of the invention.
Figure 7:
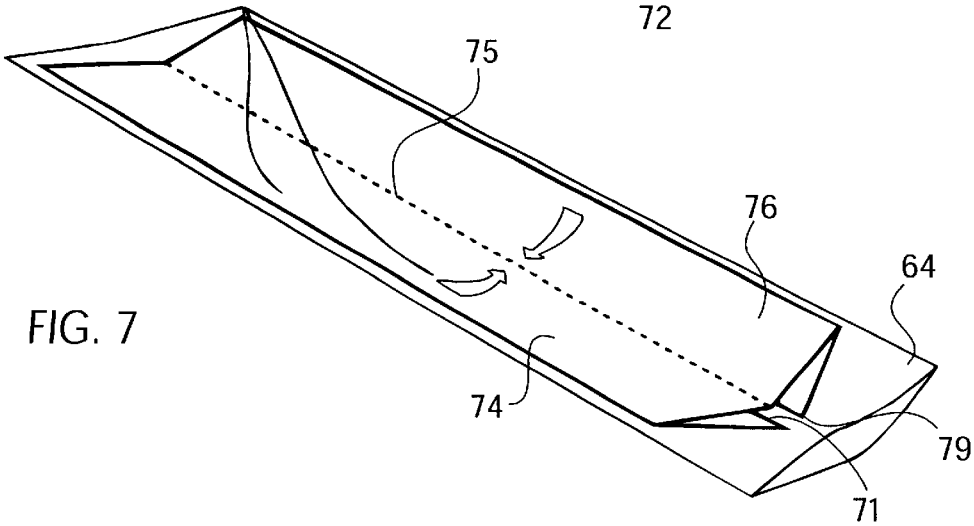
FIG. 7 shows a top perspective view of the insert of FIG. 6, with the panels being folded into an operative position.
Figure 8:
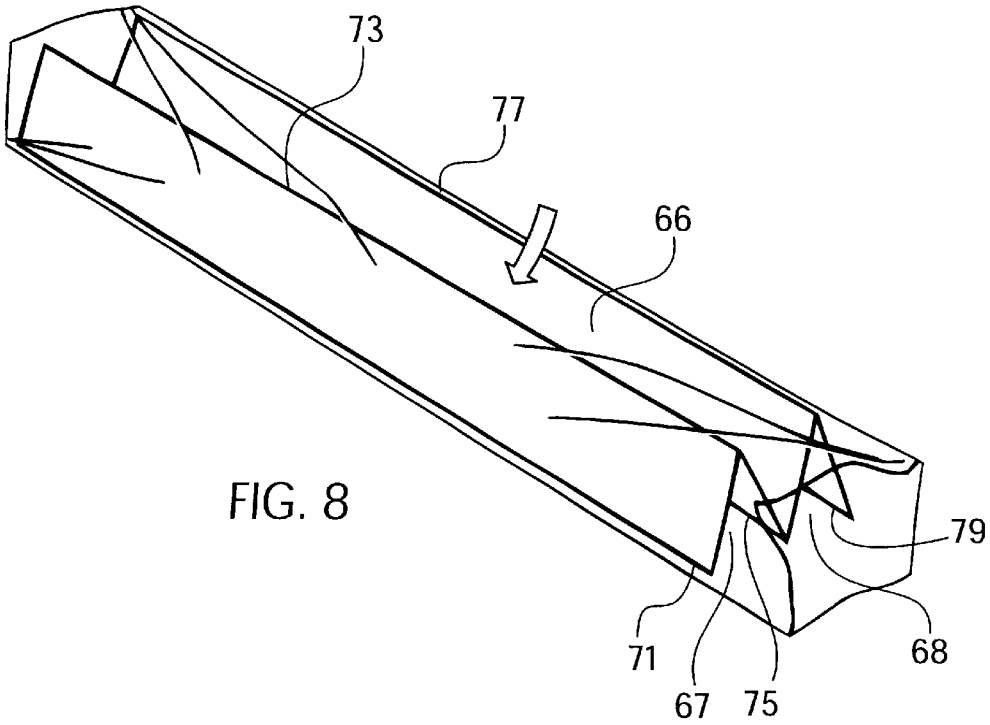
FIG. 8 shows a top perspective view of the insert of FIG. 6, with the panels folded into an operative position.

FIGS. 6 through 8 show an insert 60 which may be useful as an edge protector for placement against and protection of objects such as windows, picture frames, and the like. The sheet 62 is made up of a series of panels 72, 74, 76 and 78. Panel 72 meets panel 74 at edge (or fold line) 73. Panel 74 meets panel 76 at edge (or central fold line) 75. Panel 76 meets panel 78 and edge (or fold line) 77. In this embodiment, each of the panels 72, 74, 76 and 78 has substantially the same width. A sleeve 64 surrounds the sheet 62 and has a circumference approximating the sum of the widths of the four panels 72, 74, 76 and 78.

FIG. 6 shows the insert 60 in its flat condition. To erect the insert, the panels 74 and 76 are pushed downward and folded along central fold line 75, as shown in FIG. 7. Further folding the panels 74 and 76 causes the four panels 72, 74, 76 and 78 to form a substantially "M" shaped configuration within the sleeve 64. This tensions the sleeve 64.

An edge of a product, such as a window pane, may be placed against the area 66 of the sleeve that is tensioned between edge 73 and edge 77. In this manner, the insert 60 provides a protector for the edge of the product. As an alternative, the edge of a product may be placed against the area 67 of the sleeve that is tensioned between edge 71 and edge 75 or against the area 68 of the sleeve that is tensioned between edge 75 and 79. In addition, both area 67 and area 68 may be used to accommodate two objects.

Insert 60 may be used inside of a box. Alternatively, it may be a stand alone edge protector.

Figure 9:
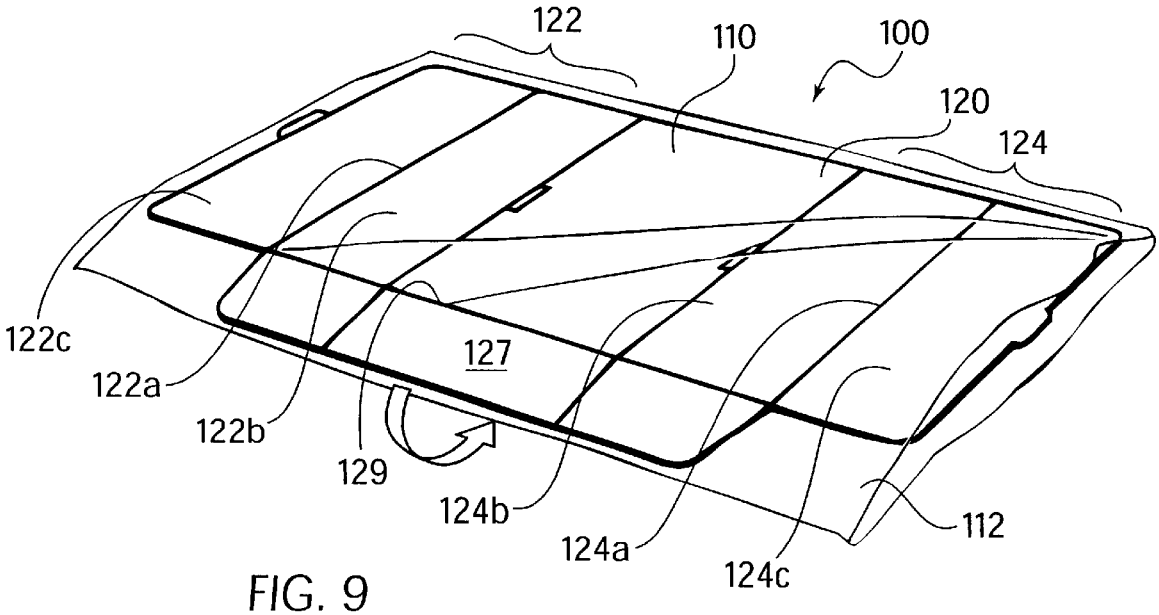
FIG. 9 shows a top perspective view of an insert in accordance with another embodiment of the invention.
Figure 10:
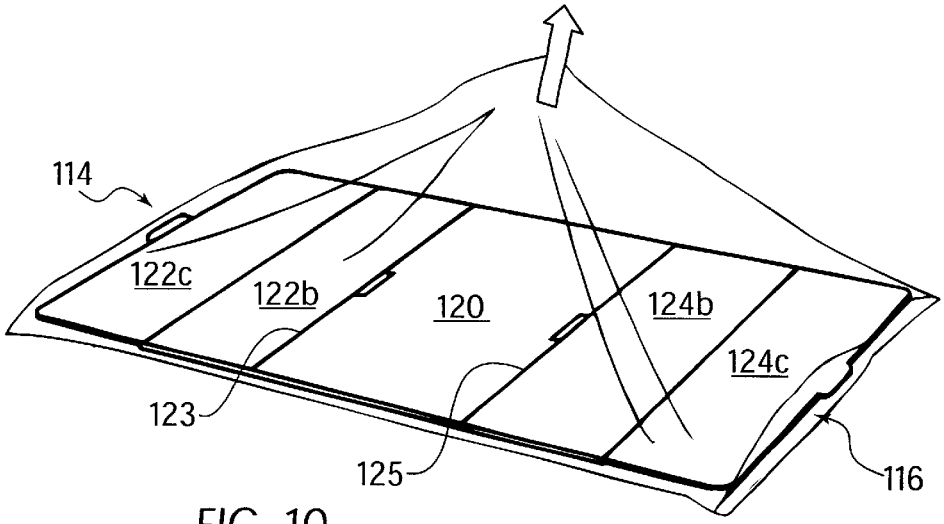
FIG. 10 shows a top perspective view of the insert of FIG. 9, with a side panel folded under the base panel and under portions of the end panels.

FIG. 9 shows an insert 100 in accordance with another embodiment of the invention. The insert 100 comprises a relatively rigid sheet 110 and a resilient element 112 in the form of a sleeve or tube.

The sheet 110 has a base panel 120 and two end panels 122 and 124. End panel 122 is divided along fold line **122*a* into two sections, 122*b* and 122*c*. End panel 124 is divided along fold line 124*a* into two sections, 124*b* and 124*c*. The end panels 122 and 124 are separated from the base panel 120 by dividing lines in the form of fold lines 123 and 125**, respectively.

The sheet 110 further comprises a side panel 127. In this embodiment, the side panel extends along part of the length of the sheet 110, adjacent the base panel 120 and the sections **122*b*, 124*b* of the end panels. It will be appreciated that the side panel 127** may be made longer or shorter.

The sleeve 112 fits around the width of the sheet 110. In this embodiment, the circumference of the sleeve 112 is approximately twice a great as the width of the sheet 110 when all of the panels, including side panel 127, lie flat and in the same plane, as shown in FIG. 1. In this manner, the sleeve 112 fits snugly around the sheet 110 when the sheet 110 is flat, as shown in FIG. 1.

To accommodate an item in the insert, the side panel 127 is folded with respect to the base panel 120 along fold line 129. This allows for the sleeve 112 to be bloused up, to allow for an item to be placed in the sleeve 112, through either of the openings 114, 116 in the ends of the sleeve 112.

Figure 11:
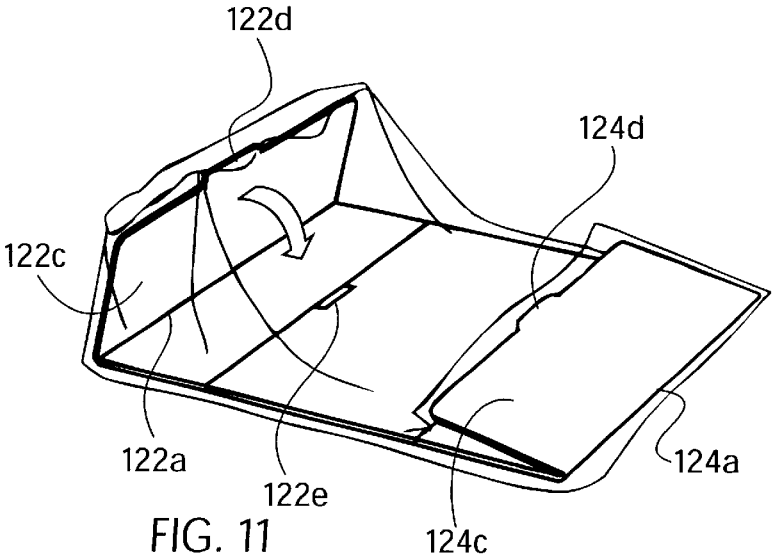
FIG. 11 shows a top perspective view of the insert of FIG. 9, with the side panel folded under the base panel and under portions of the end panels and with portions of the end panels being folded inward.
Figure 12:
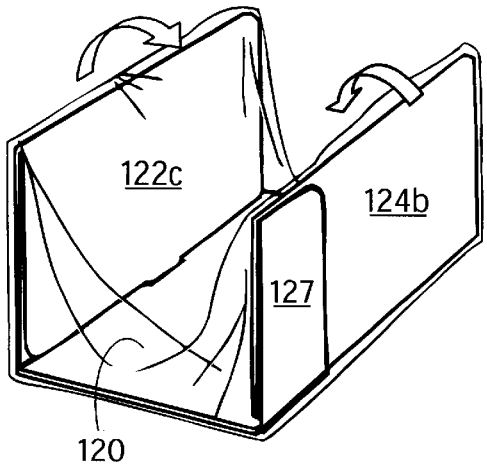
FIG. 12 shows a top perspective view of the insert of FIG. 9, with the end panels folded.

Once the product is placed within the sleeve 112, the end panels 122, 124 are folded as shown in FIG. 11. The outer sections 122*c* and 124*c* are first folded along fold lines 122*a* and 124*a*. Tabs 122*d* and 124*d* may be provided, for insertion into cutouts 122*e* and 124*e* (not shown). Then, the inner sections 122*b* and 124*d* are folded, to the position shown in FIG. 12. In this embodiment, the sleeve 112 extends all the way over both of the end panels 122 and 124. Because of this configuration, the folding of the end panels 122 and 124 as shown in FIGS. 11 and 12 tensions the sleeve 112 around the product being packaged. Of course, the extent of the sleeve 112 over the end panels 122 and 124 may be modified without departing from the scope of the invention, so long as the folding of the end panels still serves to tension the sleeve 112 around the product being packaged.

When the insert 100 is placed inside a box, the end panels 122 and 124 extend above the base panel 120 and serve to space the base panel 120 from the top of the box. Because each of the end panels 122, 124 has two sections that are folded over (i.e., sections 122*b*, 122*c* and 124*b* and 124*c*), the end panels provide extra support for the box against crushing.

FIGS. 13 through 18 show a packaging assembly 200 comprising a box 202 and an integral insert 204. The insert 204 comprises a relatively rigid sheet 210 and a resilient element 212 in the form of a sleeve or tube.

The sheet 210 has a base panel 220 and two end panels 222 and 224. Two lateral fold lines 232 and 234 extend across the length of the sheet 210, across the base panel 220 and the two end panels 222 and 224. The end panels are separated from the base panel by dividing lines 223 and 225, respectively. In the area between the two lateral fold lines 232 and 234, the dividing lines 223 and 225 are cut completely through the relatively rigid sheet 210 to separate the end panels 222 and 224 from the base panel 220 in that area. In the areas on the outside of each of the lateral fold lines 232 and 234, i.e., from each lateral fold line 232, 234 to the respective edge of the sheet 210, the dividing lines 223 and 225 are simply fold lines permitting the end panels 222 and 224 to fold with respect to the base panel 220.

Figure 13:
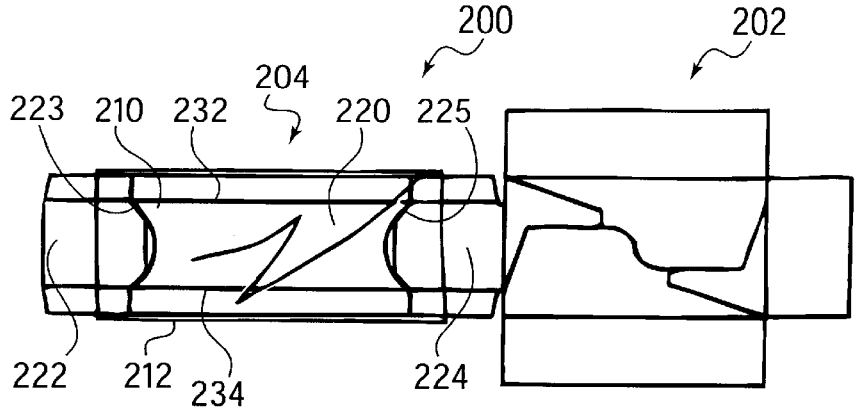
FIG. 13 shows a top perspective view of a packaging assembly in accordance with another embodiment of the invention.

The sleeve 212 fits around the width of the sheet 210. In this embodiment, the circumference of the sleeve 212 is approximately twice as great as the width of the sheet 210, or slightly more or slightly less. In this manner, the sleeve 212 fits snugly around the sheet 210 when the sheet 210 is flat, as shown in FIG. 13.

Figure 14:
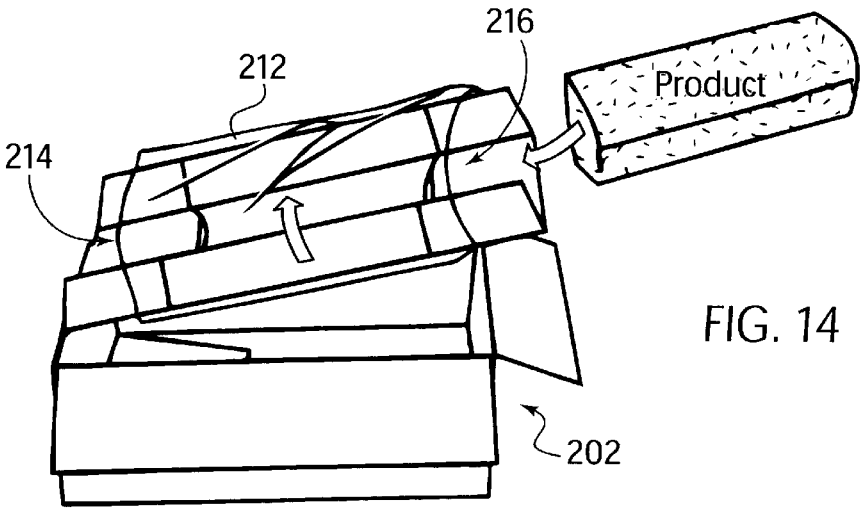
FIG. 14 shows a top perspective view of the packaging assembly of FIG. 13, with a product being placed into the insert portion of the packaging assembly.

To accommodate an item in the insert, the sheet 210 is folded at one or both of the fold lines 232, 234, as shown in FIG. 14. This blouses up the sleeve 212, to allow for an item to be placed in the sleeve 212, through either of the openings 214, 216 in the ends of the sleeve.

Figure 15:
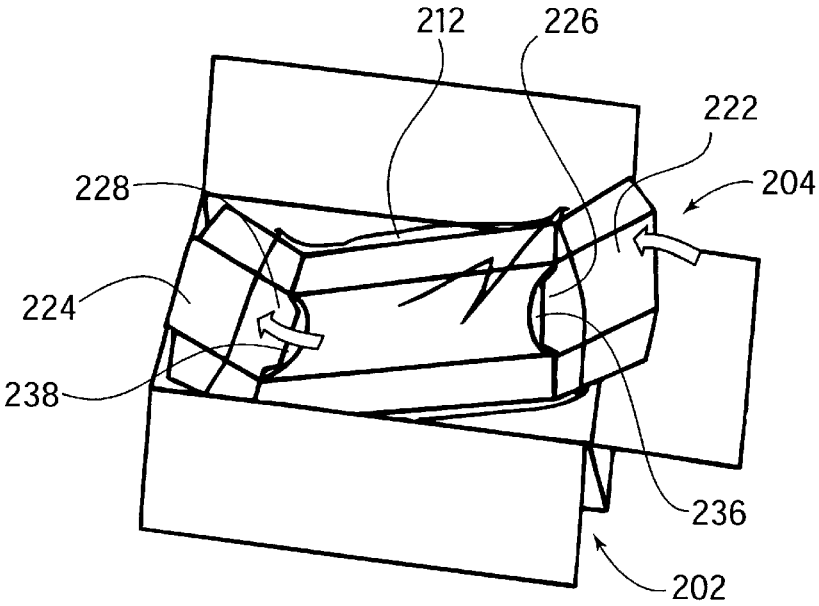
FIG. 15 shows a top perspective view of the packaging assembly of FIG. 13, with the insert portion of the packaging assembly being placed inside the internal space of the box portion of the packaging assembly.
Figure 16:
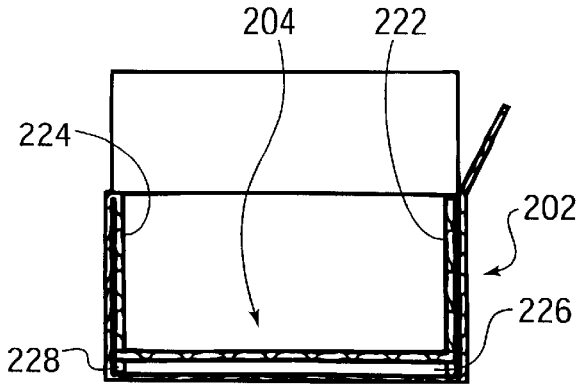
FIG. 16 shows a cross-sectional side view of the packaging box of FIG. 13, with the insert portion of the packaging box placed inside the internal space of the box.
Figure 17:
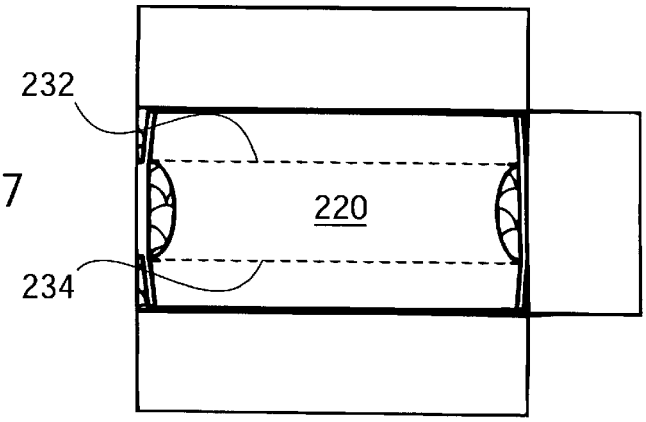
FIG. 17 shows a top view of the packaging box of FIG. 13, with the insert portion of the packaging box placed inside the internal space of the box.
Figure 18:
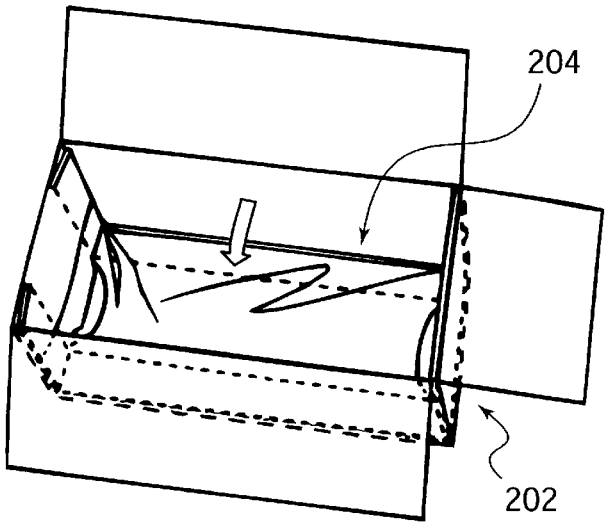
FIG. 18 shows a top perspective view of the packaging box of FIG. 13, with the insert portion of the packaging box placed inside the internal space of the box.
Figure 19:
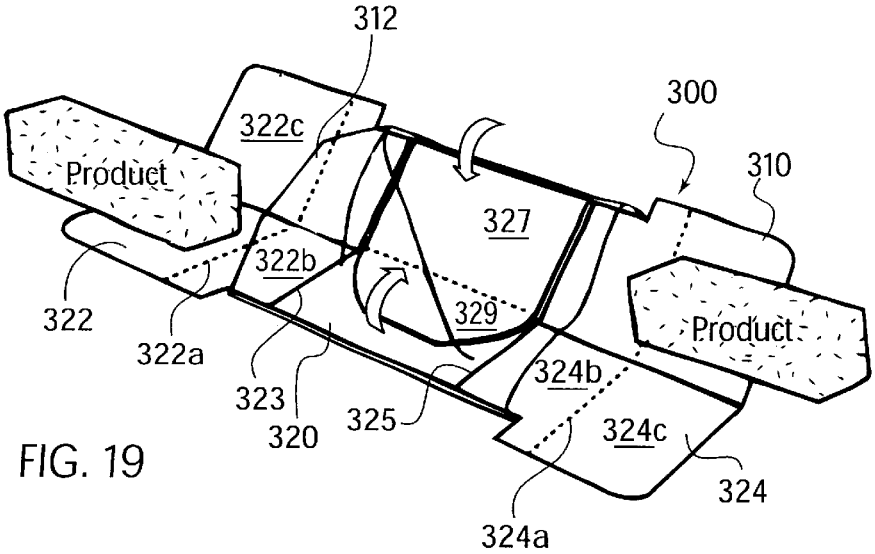
FIG. 19 shows a top perspective view of an insert in accordance with another embodiment of the invention.

Once the product is placed within the sleeve 212, the base panel 220 is returned flat. This tensions the film 212 around the product, to hold the product securely against the sheet 210. Then, as shown in FIG. 15, the insert 204 is placed inside the box 202. In doing this, the end panels 222 and 224 are folded upward with respect to the base panel 220. In this embodiment, the sleeve 212 is longer than the base panel 220 and extends part of the way over each of the end panels 222 and 224. Because of this configuration, the folding of the end panels 222 and 224 further tensions the sleeve 212.

Cutouts 236 and 238 may be provided between the base panel 220 and the end panels 222 and 224, respectively. Because of the complete separation of the end panels 222 and 224 from the base panel 220 along central portions of the dividing lines 223 and 225, the end panels 222 and 224 have leg portions 226 and 228 that extend downward, below the base panel 220, when the end panels 222 and 224 are folded upward. When the insert 204 is placed inside the box 202, the leg portions 226 and 228 serve to space the base panel 220 from the bottom of the box. The portions of the end panels 222 and 224 that extend above the base panel 220 serve to space the base panel 220 from the top of the box.

Of course, other variants of inserts within the scope of the invention may also be constructed integrally with a box, as in the embodiment of FIGS. 13 through 18. In addition, the packaging kit may alternatively be constructed as an insert in combination with a series of panels that form a folder. It will be appreciated by persons of ordinary skill in the art that a packaging kit with an insert in combination with a box or folder can be constructed such that both the insert and box or folder can be collapsed to lie flat for shipping, to be later erected for use. The embodiment of FIGS. 13 through 18 is such a construction.

FIGS. 19 through 23 show another embodiment of an insert in accordance with the invention. The insert 300 comprises a relatively rigid sheet 310 and a resilient element 312 in the form of a sleeve or tube.

The sheet 310 has a base panel 320 and two end panels 322 and 324. A central fold line 330 extends across the length of the sheet 310, across the base panel 320 and the two end panels 322 and 324. End panel 322 is divided along fold line 322*a* into two sections, 322*b* and 322*c*. End panel 324 is divided along fold line 324*a* into two sections, 324*b* and 324*c*. The end panels 322 and 324 are separated from the base panel 320 by dividing lines in the form of fold lines 323 and 325, respectively.

The sheet 310 further comprises a divider extension panel 327 and a divider panel 329. In this embodiment, the divider extension panel 327 and divider panel 329 extend along the length of the base panel 320, although it will be appreciated that they may be made longer or shorter.

The sleeve 312 fits around the width of the base panel 320. In this embodiment, the circumference of the sleeve 312 is approximately twice as great as the width of the base panel 320, or slightly more or slightly less. In this manner, the sleeve 312 fits snugly around the base panel 320 when the base panel 320 is flat.

Figure 20:
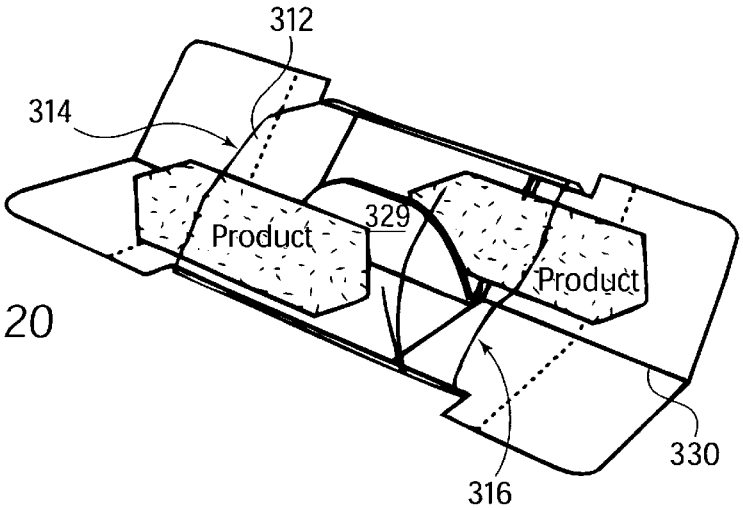
FIG. 20 shows a top perspective view of the insert of FIG. 19, with products being placed into the insert.

To accommodate an item in the insert, the sheet 310 is folded at central fold line 330, as shown in FIG. 20. This blouses up the sleeve 312, to allow for items to be placed in the sleeve 312, through either of the openings 314, 316 in the ends of the sleeve. The divider extension panel 327 and the divider panel 329 divide the area inside the sleeve 312 into two, or possibly three, compartments. The two main compartments are on either side of the divider panel 329. A third compartment, consisting of the space between divider extension panel 327 and base panel 320, may also be used for thin objects, such as plates. It will be appreciated that further divider panels may also be provided. Thus, multiple products may be shipped securely in one insert.

Once the products are placed within the sleeve 312, the base panel 320 is returned flat, or relatively flat. This tensions the film 312 around the products, to hold the products securely against the sheet 310.

Figure 21:
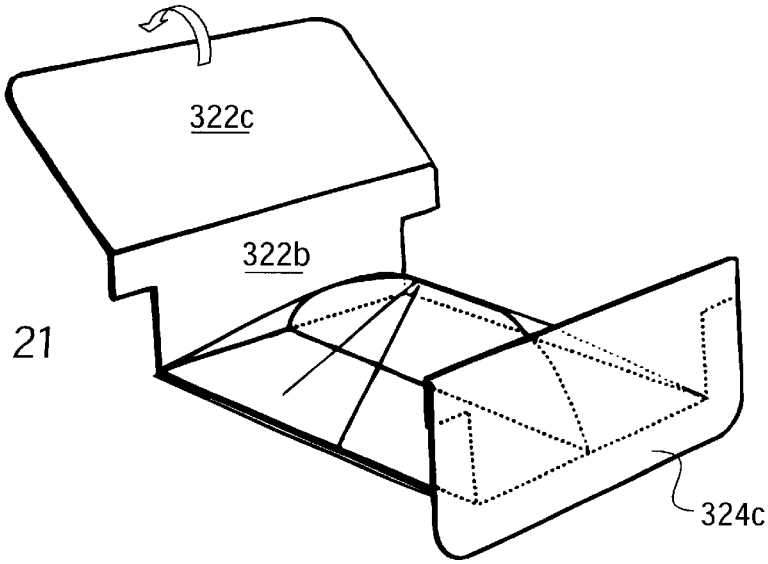
FIG. 21 shows a top perspective view of the insert of FIG. 19, with end panels being folded.
Figure 22:
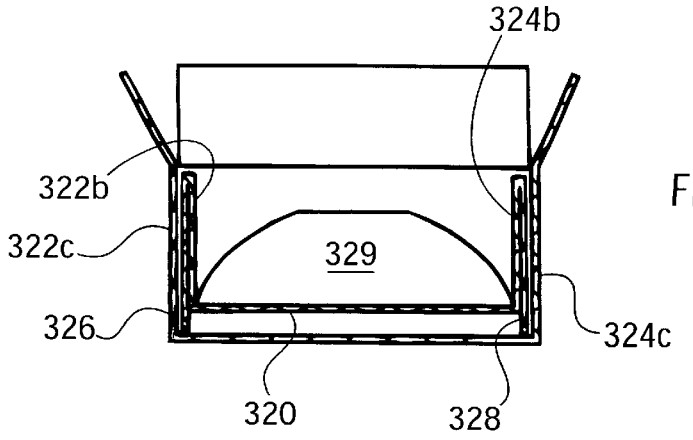
FIG. 22 shows a cross-sectional side view of the insert of FIG. 19, placed inside a box.
Figure 23:
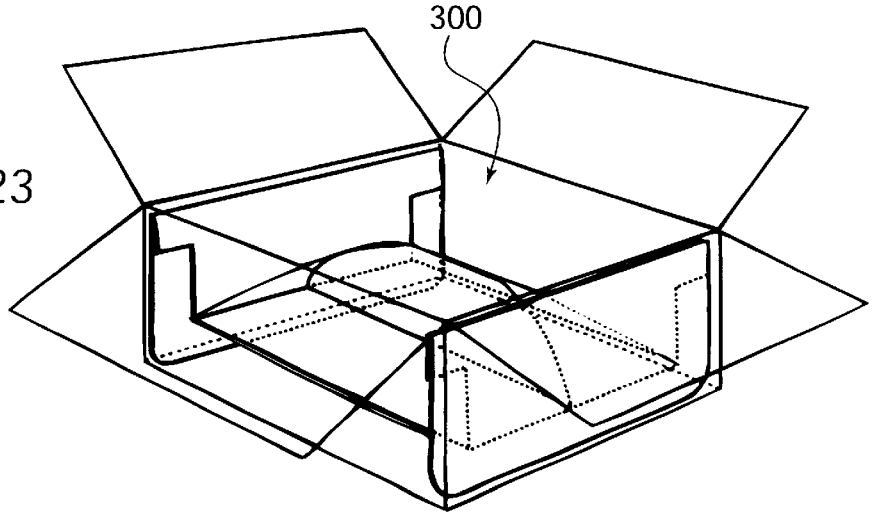
FIG. 23 shows a top perspective view of the insert of FIG. 19 inside a box.
Figure 24:
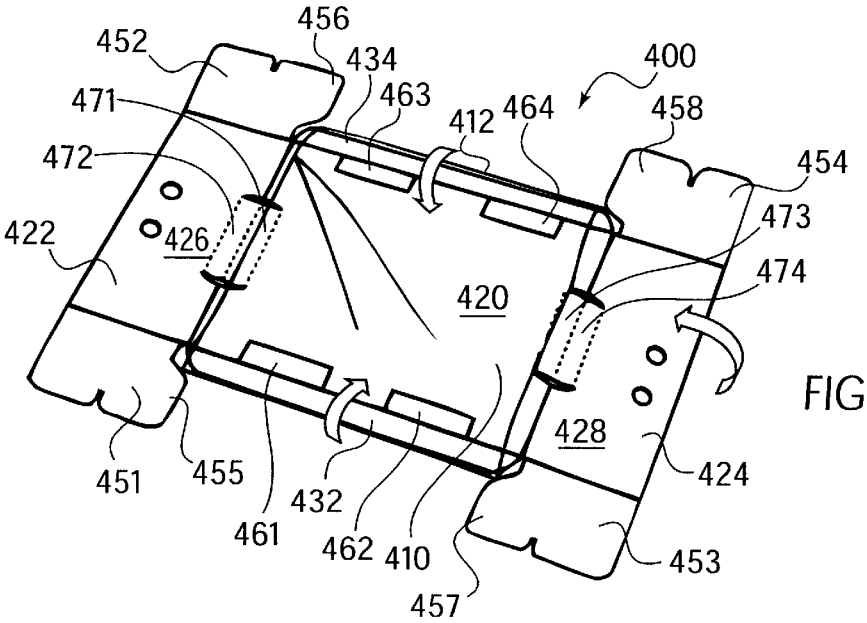
FIG. 24 shows a top perspective view of an insert in accordance with another embodiment of the invention.

As shown in FIG. 21, the end panels 322 and 324 are then folded. Sections 322*b* and 324*b* are folded upward, and then sections 322*c* and 324*c* are folded downward. In this embodiment, the sections 322*c* and 324*c* are longer than the sections 322*b* and 324*b*. Thus, portions 326 and 328 of the sections 322*c* and 324*c* extend below the base panel 320. When the insert 300 is placed inside a box, as shown in FIGS. 22 and 23, the portions 326 and 328 serve to space the base panel 320 from the bottom of the box. The portions of the end panels 322 and 324 that extend above the base panel 320 serve to space the base panel 320 from the top of the box.

FIGS. 24 through 27 show another insert 400 in accordance with another embodiment of the invention. The insert 400 comprises a relatively rigid sheet 410 and a resilient element 412 in the form of a sleeve or tube. The sheet 410 has a base panel 420 and two end panels 422 and 424.

In the insert 400, the end panels 422 and 424 have central sections 426 and 428 and side flaps 451, 452, 453 and 454. Each of the side flaps has a tab 455, 456, 457 and 458. The base panel 420 has cutouts 461, 462, 463 and 464 for receiving the tabs 455, 456, 457 and 458. Side panels 432 and 434 extend from the sides of the base panel 420.

Figure 25:
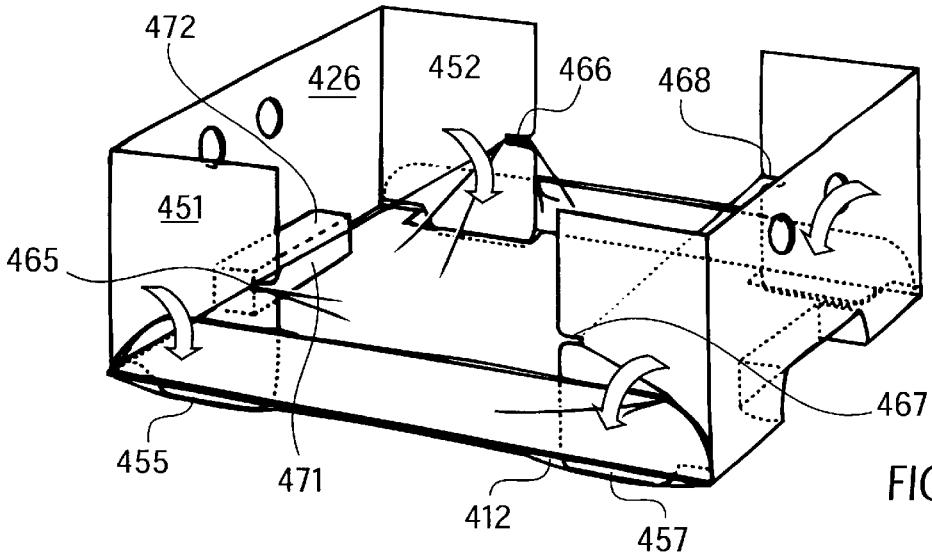
FIG. 25 shows a top perspective view of the insert of FIG. 24, with the end panels folded.
Figure 26:
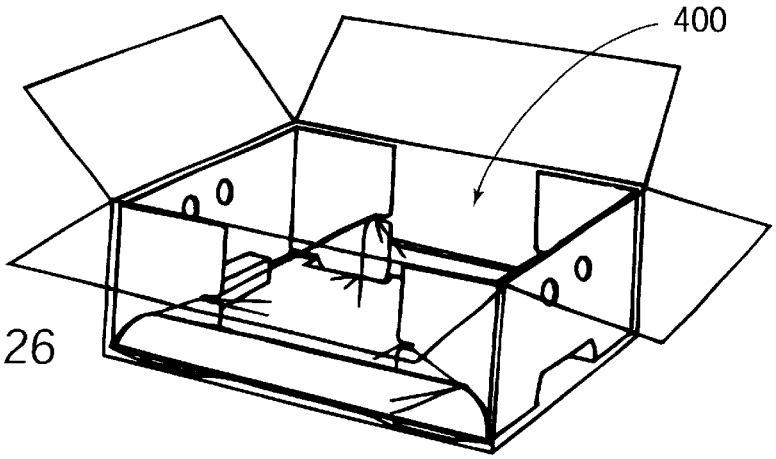
FIG. 26 shows a top perspective view of the insert of FIG. 24, placed inside a box.
Figure 27:
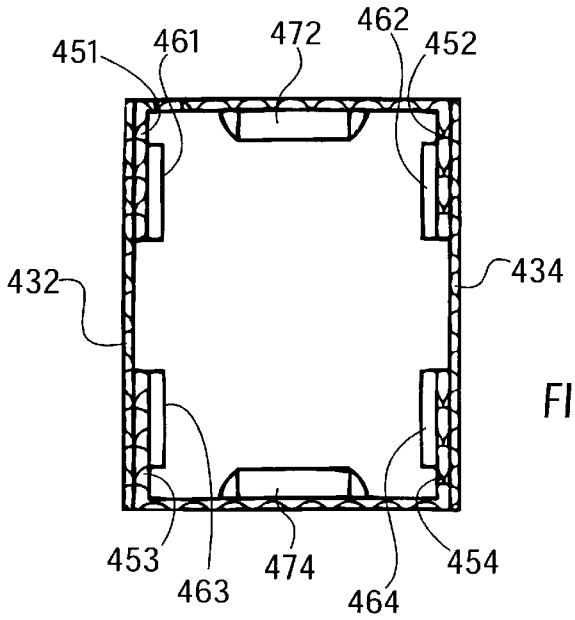
FIG. 27 shows a top view of the insert of FIG. 24, with the end panels folded.

After an item to be shipped has been placed in the insert, the side panels 432 and 434 are folded upward, relative to the base panel 420. Then, the side flaps 451–454 are folded upward relative to the central sections 426 and 428, and the central sections 426 and 428 are folded upward relative to the base panel 420. The side flaps 451–454 are positioned so that they extend inside of the side panels 432 and 434 and into the cutouts 461–464. As shown in FIG. 25, the tabs 455–458 press on the sleeve 412 on the underside of the cutouts 461–464 in the base panel 420. This provides improved tensioning of the sleeve for retention of the product.

The side flaps have notches 465, 466, 467 and 468, into which the edges of the sleeve 412 may be placed. This helps provide adjustable tensioning for the sleeve 412. In some instances, it may be desirable not to utilize the notches. In such instances the top portion of the sleeve 412 may be pushed through the cutouts 461–464 by tabs 455–458.

At the areas where the base panel 420 meets the central sections 426 and 428, support panels 471, 472, 473 and 474 may be provided. When the central sections 426 and 428 are folded relative to the base panel 420, these support panels form spacers for distancing the product being shipped from the ends of the insert, and thus the sides of the box. This provides still further protection for the product being shipped.

FIGS. 28 through 32 show an insert 500 in accordance with another embodiment of the invention. The insert 500 comprises a relatively rigid sheet 510 and a resilient element 512 in the form of a sleeve or tube.

The sheet 510 has a base panel 520 and two end panels 522 and 524. End panel 522 is divided along fold lines 522*a* and 522*b* into three sections, 522*c*, 522*d* and 522*e*. End panel 524 is divided along fold lines 524*a* and 524*b* into three sections, 524*c*, 524*d* and 524*e*. The end panels 522 and 524 are separated from the base panel 520 by dividing lines in the form of fold lines 523 and 525, respectively.

Figure 28:
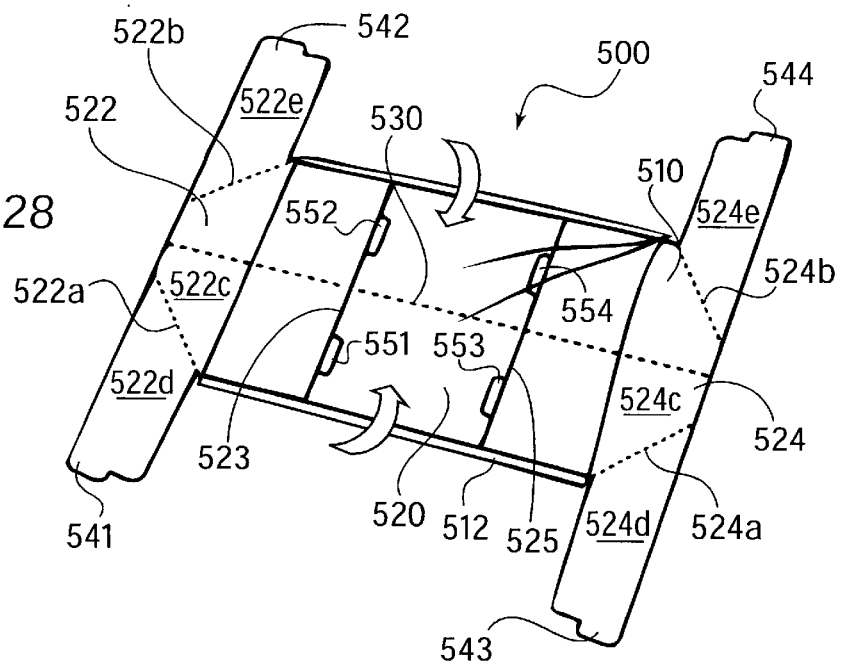
FIG. 28 shows a top perspective view of an insert in accordance with another embodiment of the invention.

The sleeve 512 fits around the width of the sheet 510. In this embodiment, the circumference of the sleeve 512 is approximately twice as great as the width of the sheet 510, as shown in FIG. 28. In this manner, the sleeve 512 fits snugly around the base panel 520 when the sheet 510 is flat, as shown in FIG. 28.

Figure 29:
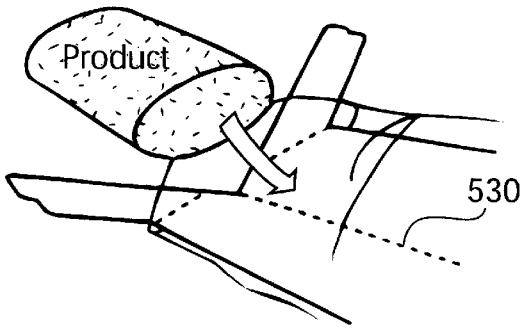
FIG. 29 shows a partial view of the insert of FIG. 28, with a product being placed into the insert.
Figure 30:
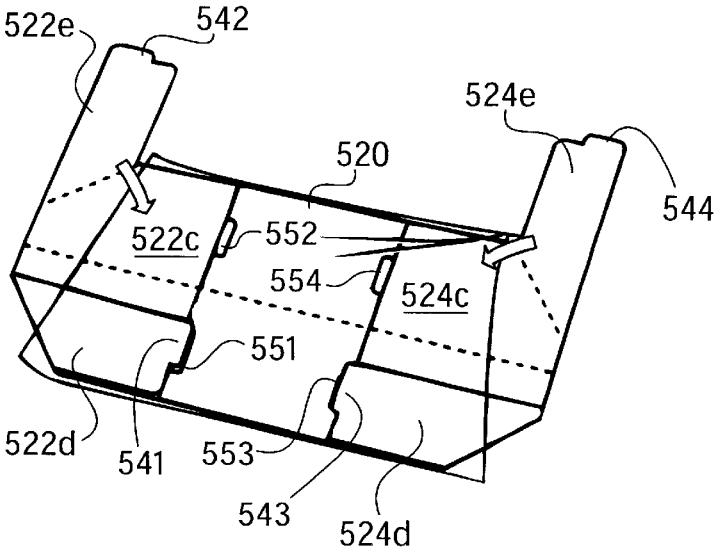
FIG. 30 shows a top perspective view of the insert of FIG. 28, with the end panels being folded.
Figure 31:
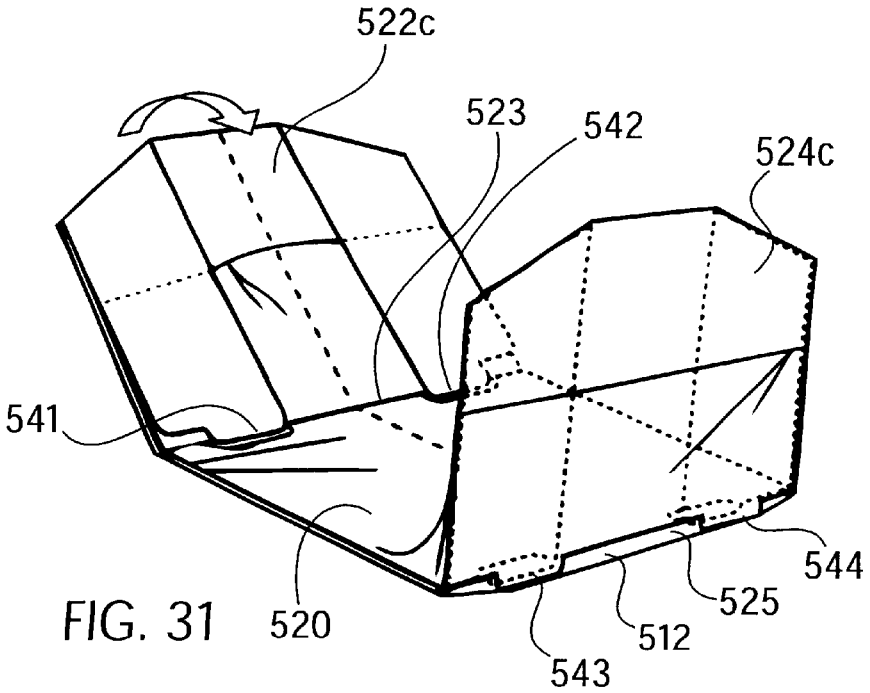
FIG. 31 shows a top perspective view of the insert of FIG. 28, with the end panels being further folded.
Figure 32:
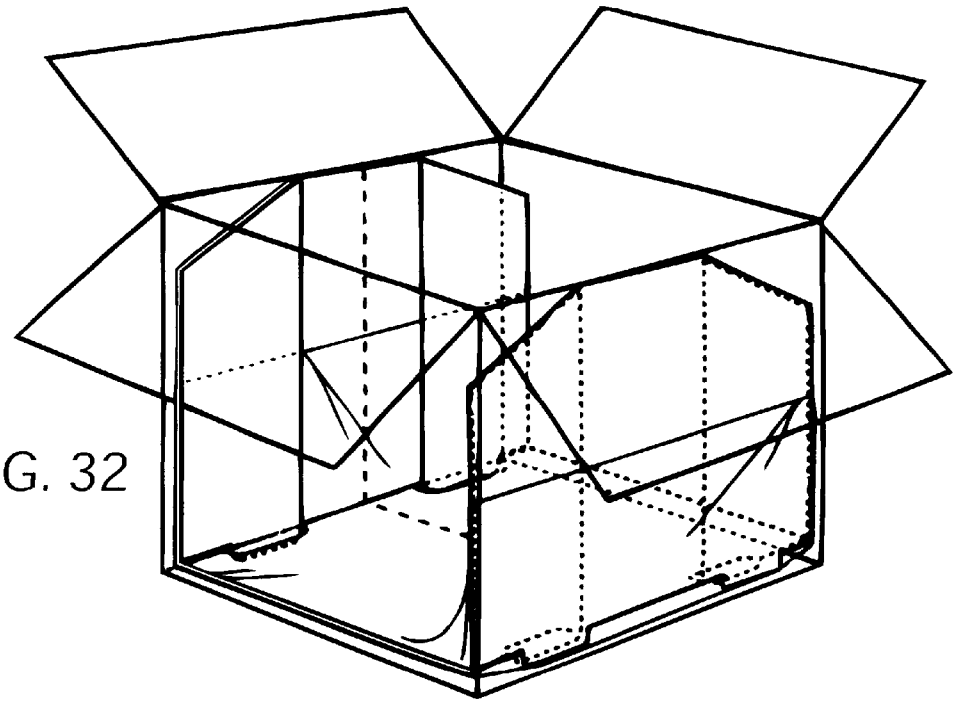
FIG. 32 shows a top perspective view of the insert of FIG. 28, placed inside a box.

The base panel has a fold line 530, allowing it to be folded to blouse up the sleeve 512 for accommodating a product, as shown in FIG. 29. Once the product is placed within the sleeve 512, the end panels 522, 524 are folded as shown in FIGS. 30 and 31. The outer sections 522*d*, 522*e*, 524*d* and 524*e* have tabs 541, 542, 543 and 544, for insertion into cutouts 551, 552, 553 and 554 in the base panel 520. Once the outer sections 522*d*, 522*e*, 524*d* and 524*e* are folded along fold lines 522*a*, 522*b*, 524*a* and 524*b* with respect to the inner sections 522*c* and 524*c*, the inner sections 522*c* and 524*c* are folded along fold lines 523 and 525 with respect to the base panel 520. As shown in FIG. 31, the tabs 541–544 press the sleeve 512 through the cutouts 551–554, thereby further tensioning the sleeve 512.

It will be appreciated by persons of ordinary skill in the art that the construction of the end panels in the insert 500 allows for the insert to have a substantial height as well as double-layered ends for better support for the box. Because of the angled fold lines 522*a*, 522*b*, 524*a* and 524*b*, this is accomplished while keeping the length of the insert blank reduced. That is, the sections 522*d*, 522*e*, 524*d* and 524*e* increase the width, but not the length, of the blank. As would be appreciated by persons of ordinary skill in the art, this provides benefits in manufacturing the blank.

Figure 33:
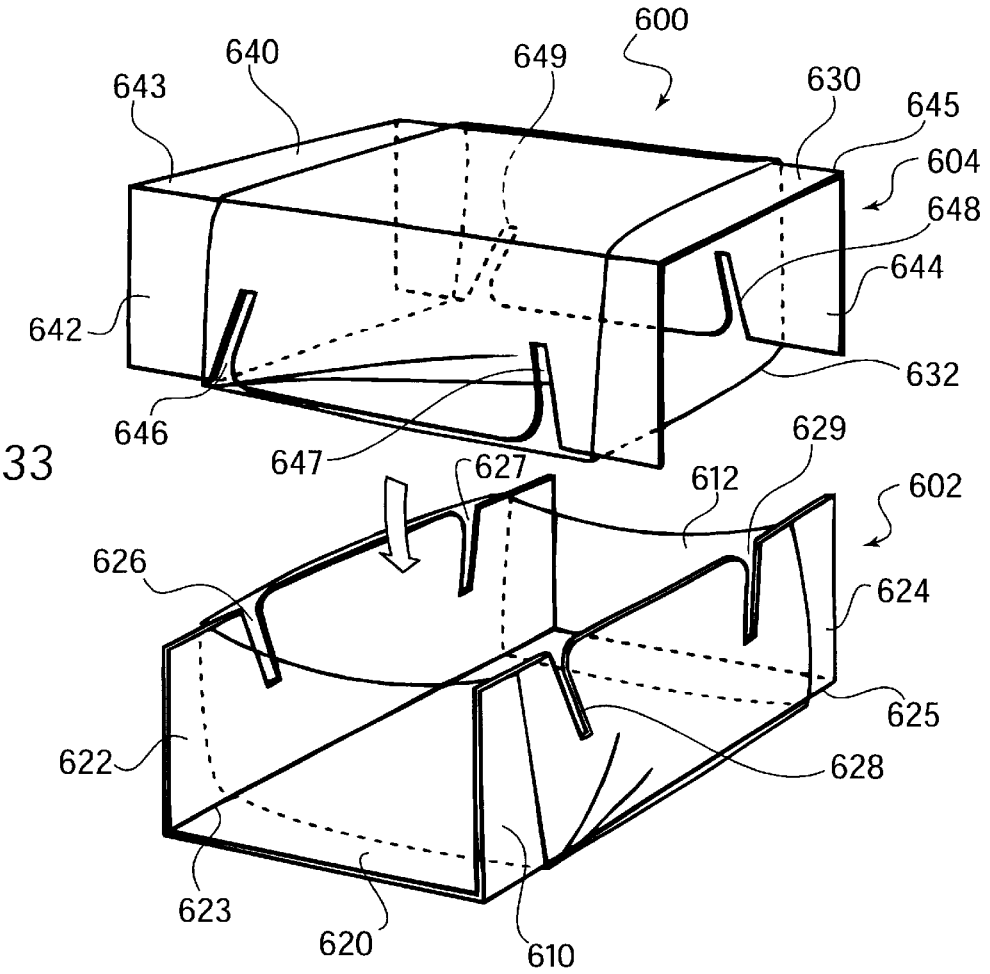
FIG. 33 shows a top perspective view of two insert components being joined together in accordance with another embodiment of the invention.
Figure 34:
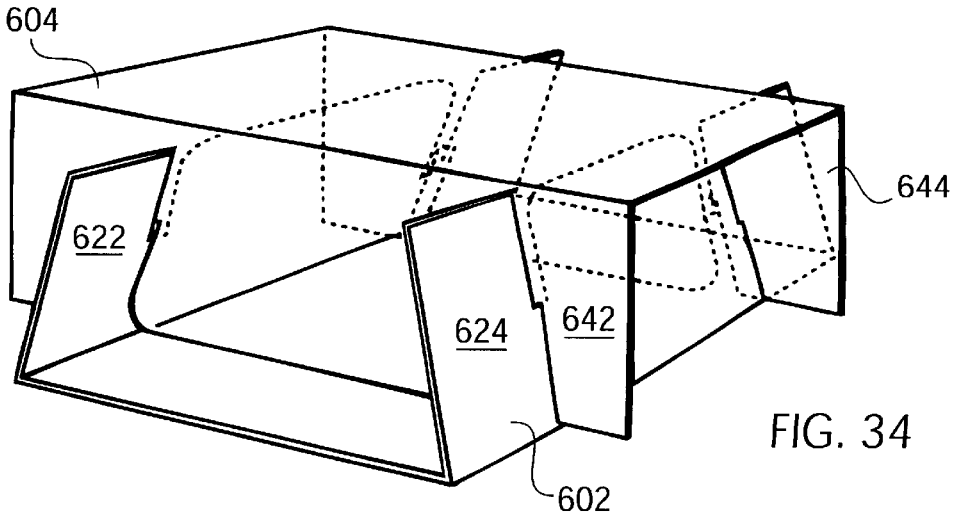
FIG. 34 shows a top perspective view of the two insert components of FIG. 33, joined together in an interlocked manner.
Figure 35:
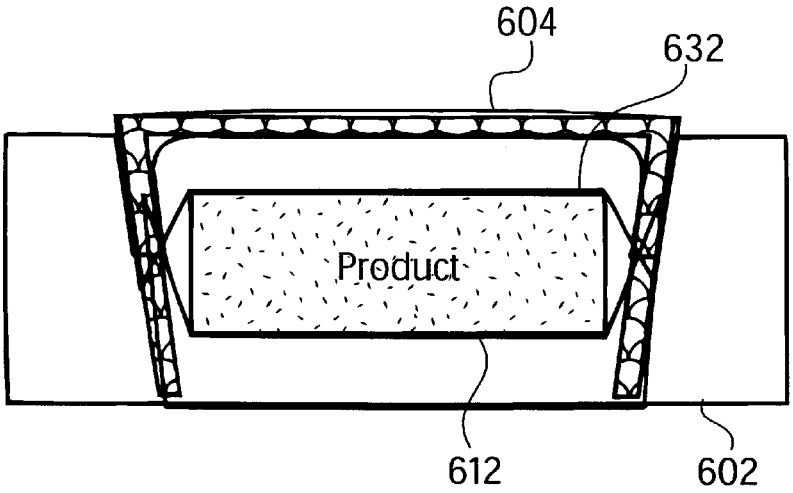
FIG. 35 shows a cross-sectional side view of the two insert components of FIG. 33, showing a product secured in place.
Figure 36:
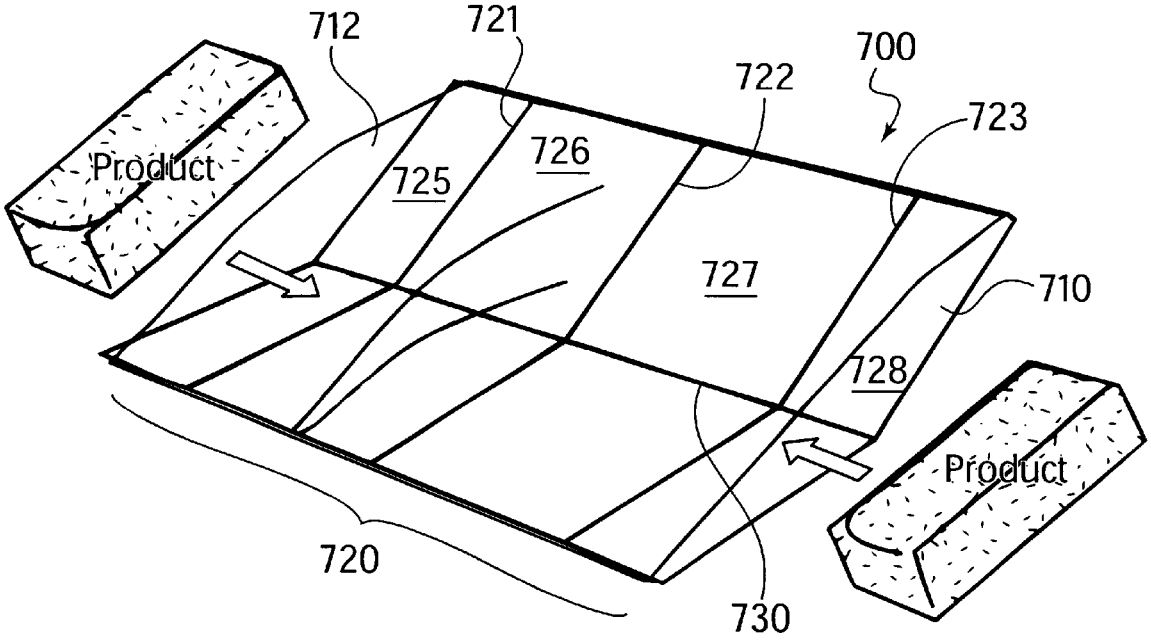
FIG. 36 shows a top perspective view of an insert in accordance with another embodiment of the invention.

FIGS. 33 through 35 show an alternative construction of insert. The insert 600 is formed in two parts 602 and 604. These two parts 602 and 604 have the same construction.

Part 602 comprises a relatively rigid sheet 610 and a resilient element 612 in the form of a sleeve or tube. The sheet 610 has a base panel 620 and two side panels 622 and 624. The side panels are foldable with respect to the base panel 620 along fold lines 623 and 625. Side panel 622 has notches 626 and 627, and side panel 624 has notches 628 and 629.

Part 604 comprises a relatively rigid sheet 630 and a resilient element 632 in the form of a sleeve or tube. The sheet 630 has a base panel 640 and two side panels 642 and 644. The side panels are foldable with respect to the base panel 640 along fold lines 643 and 645. Side panel 642 has notches 646 and 647, and side panel 644 has notches 648 and 649.

In operation, a product is placed on the part 602, on the outside of the sleeve 612, in the area between the two side panels 622 and 624. The part 604 is then placed onto the part 602, with the notches 646–649 interlocking with the notches 626–629. Thus, the outside of the sleeve 632, in the area between the two side panels 642 and 644 presses on the product. This causes the product to be tensioned between the two sleeves 612 and 632, as shown in FIG. 35.

It will be appreciated by persons of ordinary skill in the art that the insert of FIGS. 33 through 35 differs from that shown in FIGS. 1–5 and 9–32 with respect to placement of the products to be shipped relative to the sleeve. In the embodiment of FIGS. 33 through 35, as in the embodiment of FIGS. 6 through 8, the product is secured against the outside of the sleeve, while in the embodiments of FIGS. 1–5 and 9–32, the product is placed inside the sleeve.

FIGS. 36 through 43 show a further insert in accordance with the invention. The insert 700 comprises a relatively rigid sheet 710 and a resilient element 712 in the form of a sleeve or tube.

The sheet 710 has a base panel 720 divided into sections 725, 726, 727 and 728 by fold lines 721, 722 and 723 that extend across the width of the base panel 720. One or more fold lines 730 may be provided across the length of the base panel 720 to allow the base panel 720 to be folded to blouse up the sleeve 712 for accommodation of products.

Figure 37:
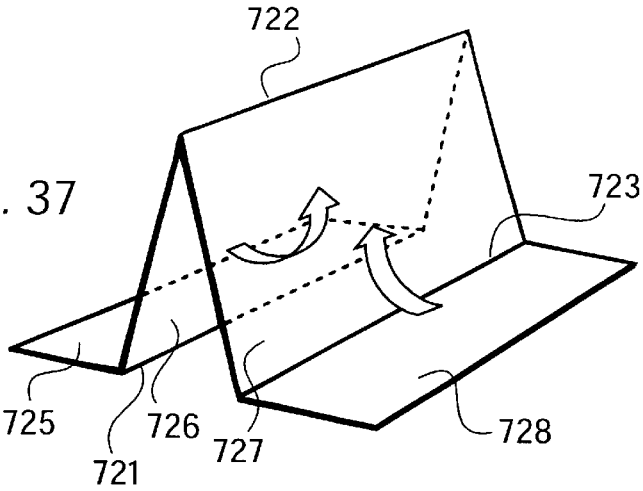
FIG. 37 shows a top perspective view of the insert of FIG. 36, with divider panels being folded.

As shown in FIG. 37, the sections 725–728 may be folded about fold line 721–723 to divide the insert into compartments. Thus, one compartment is formed by sections 725 and 726 and the sleeve 712 on one side of the fold line 722, and a second compartment is formed by sections 727 and 728 and the sleeve 712 on the other side of the fold line 722. The division of the base panel into sections allows for the separate accommodation of multiple products. Of course, further sections may be provided for further compartments.

Figure 38:
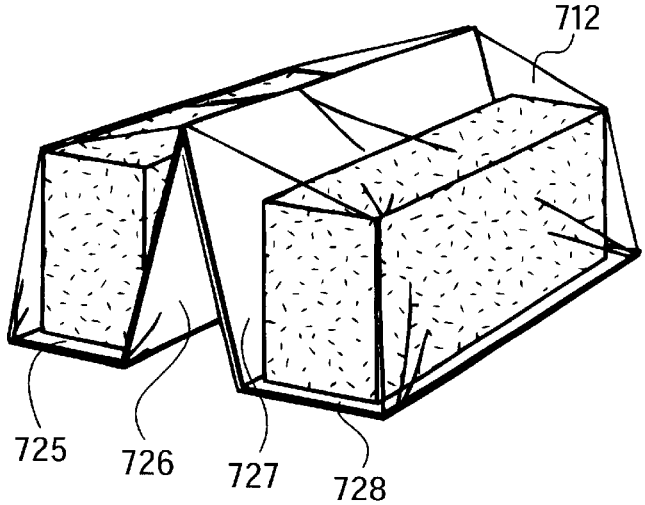
FIG. 38 shows a top perspective view of a variation of the insert of FIG. 36, with products placed in the insert.

FIG. 38 shows products in the two separate compartments. It will be appreciated that FIG. 38 shows a variant in which the sleeve 712 is oriented at a 90 degree angle with respect to that shown in FIG. 36.

Figure 39:
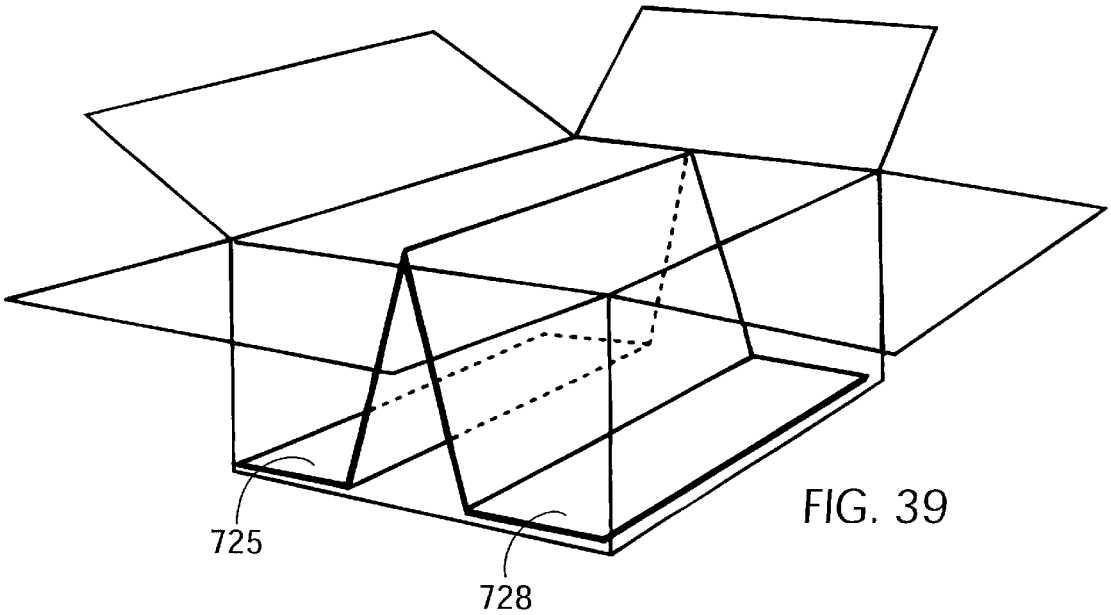
FIG. 39 shows a top perspective view of the insert of FIG. 36, placed inside a box.
Figure 40:
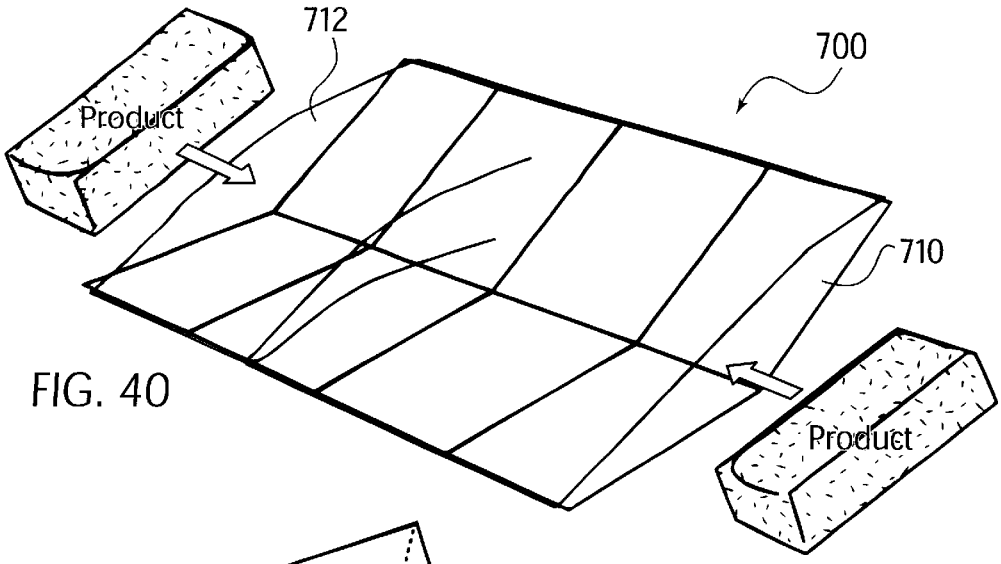
FIG. 40 shows a top perspective view of the insert of FIG. 36, for use in a different arrangement.

As shown in FIG. 38, in the assembled condition, the sections 725 and 728 lie parallel to each other. When placed in a box as shown in FIG. 39, these sections 725 and 728 lie flat against the bottom of the box.

Figure 41:
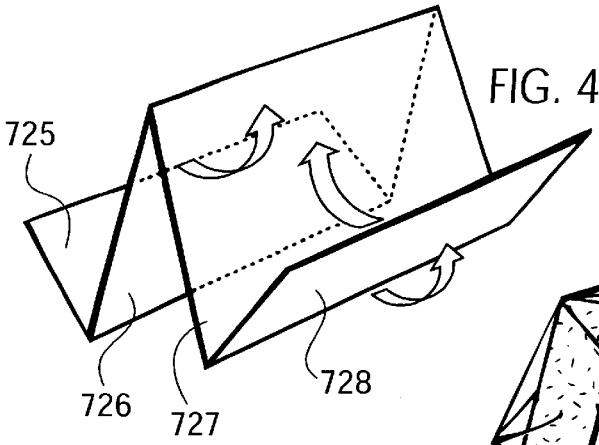
FIG. 41 shows a top perspective view of the insert of FIG. 40, with divider panels being folded.
Figure 42:
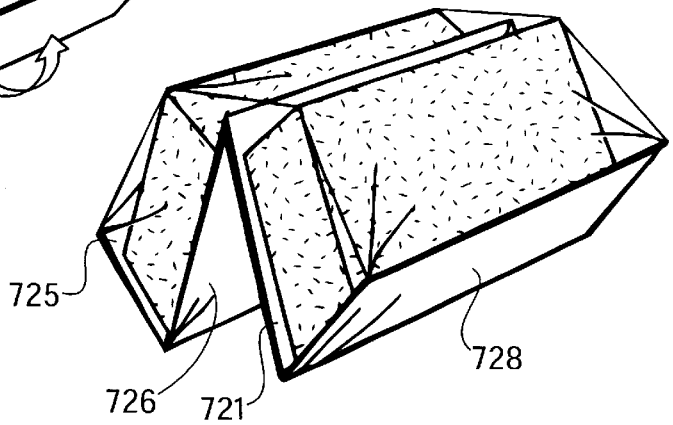
FIG. 42 shows a top perspective view of a variation of the insert of FIG. 40, with products placed in the insert.
Figure 43:
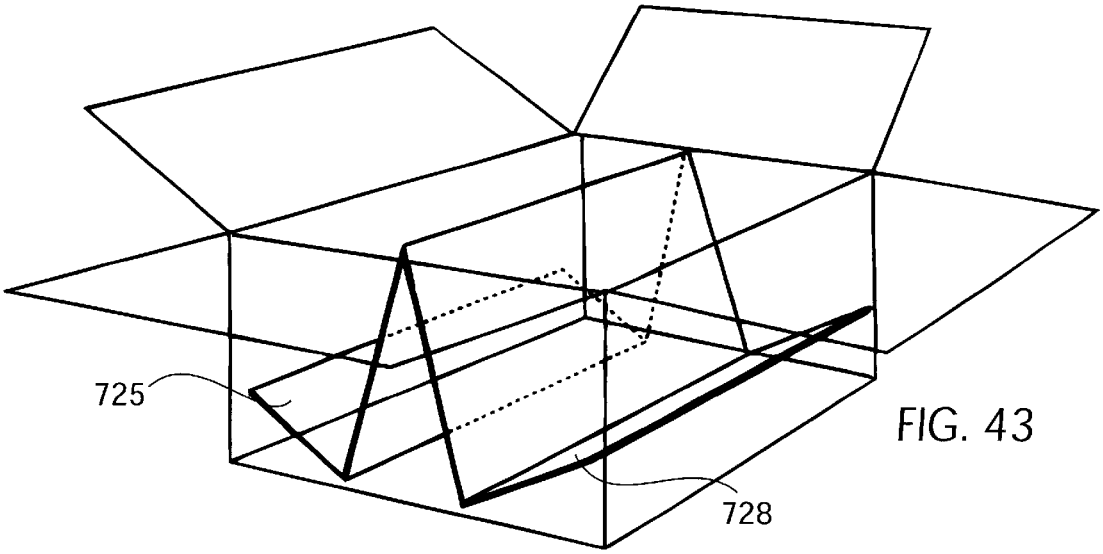
FIG. 43 shows a top perspective view of the insert of FIG. 40, placed inside a box.

An alternate use of the insert 700 is shown in FIGS. 40 through 43. In FIGS. 41 through 43, the sections 725 and 728 are shown angled in the assembled condition. Thus, as shown in FIG. 43, the sections 725 and 728 do not lie flat against the bottom of the box. This arrangement is beneficial when it is desired to distance the products form the sides of the box and to provide extra protection against the sides of the box.

Figure 44:
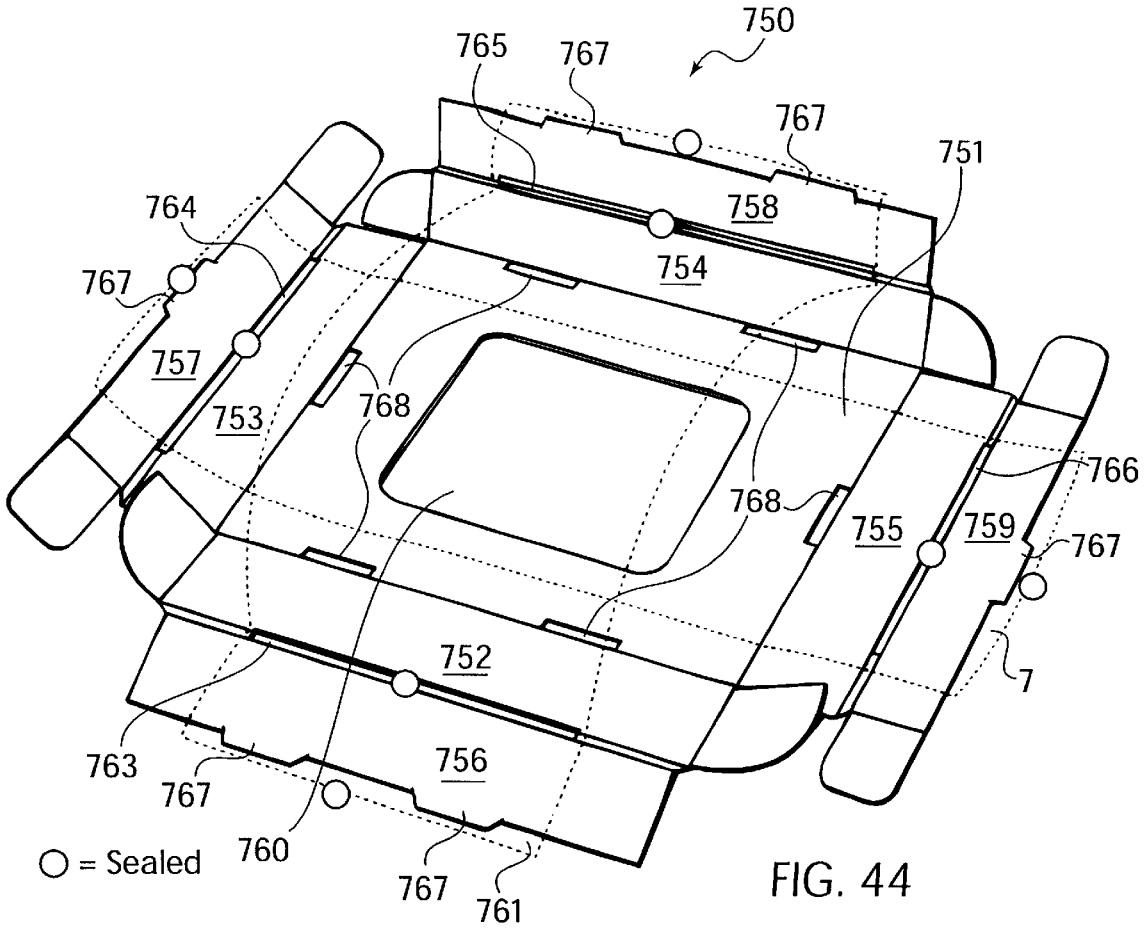
FIG. 44 shows a top perspective view of an insert in accordance with another embodiment of the invention.
Figure 45:
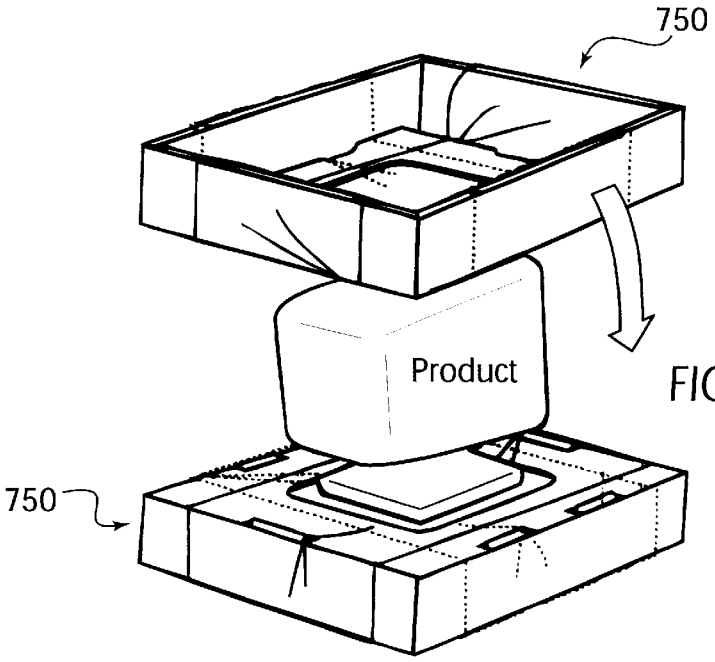
FIG. 45 shows a top perspective view of two inserts of the type shown in FIG. 44, being used together to secure a product.
Figure 46:
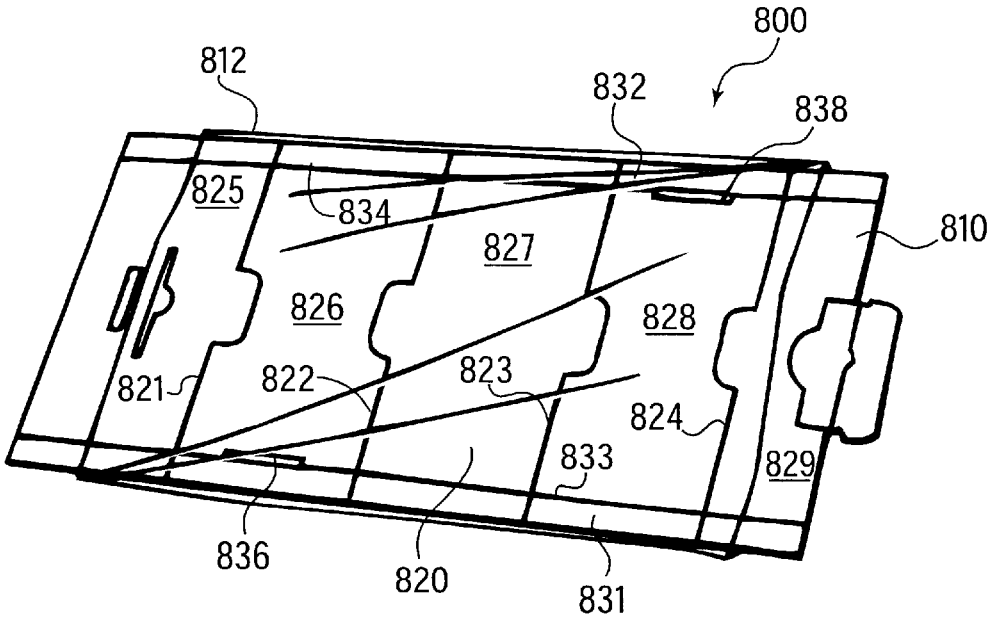
FIG. 46 shows a top perspective view of an insert in accordance with another embodiment of the invention.

FIGS. 44 and 45 show another version of an insert. In this version, the insert 750 comprises a relatively rigid sheet 751 and two resilient elements in the form of a sleeves of plastic film 761 and 762. The relatively rigid sheet has a series of inner side panels 752 through 755 and 756 through 759. In the areas between the inner side panels and the outer side panels, the relatively rigid sheet has a series of cutouts 763 through 766. The portions of the sleeves 761 and 762 on opposite sides of the sheet are adhered to each other, for example by heat sealing, through the cutouts 763 through 766.

The relatively rigid sheet 751 has a central cutout 760. Folding the side panels 752 through 759 so that tabs 767 insert into cutouts 768 tensions the sleeves 761 and 762 across the central cutout 760. Thus, the insert forms a frame, with film tensioned across the cutout 760. In this embodiment, there are four layers of film. With the use of just one sleeve, there would be just two layers of film.

As shown in FIG. 45, two inserts 750 may be used in conjunction with each other to secure opposite sides of an object.

FIGS. 46 through 50 show another version of an insert in accordance with the invention. The insert 800 comprises a relatively rigid sheet 810 and a resilient element 812 in the form of a sleeve or tube.

The sheet 810 has a base panel 820 divided into sections 825, 826, 827, 828 and 829 by fold lines 821, 822, 823 and 824 that extend across the width of the base panel 820. Two side panels 831 and 832 are provided, foldable with respect to the base panel 820 by fold lines 833 and 834.

Figure 47:
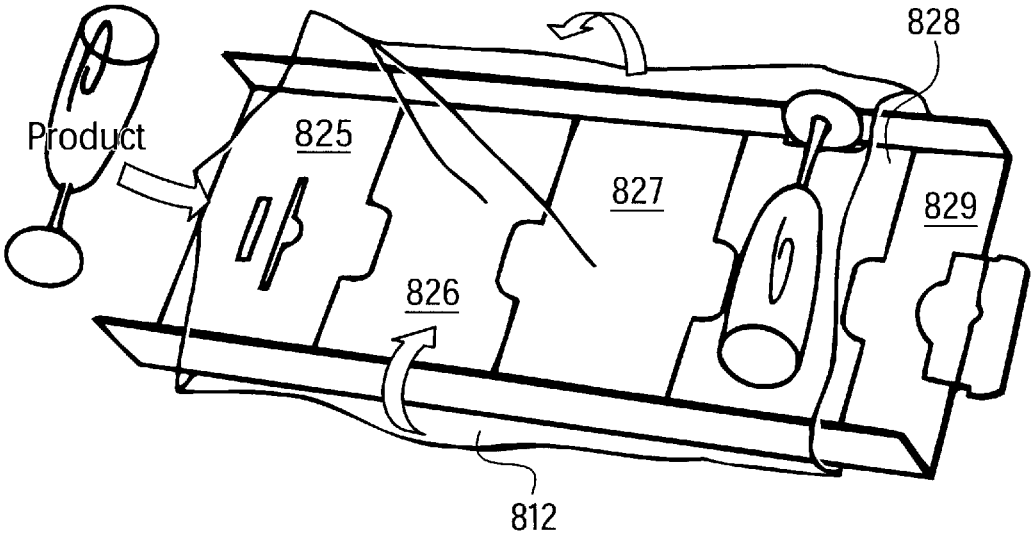
FIG. 47 shows a top perspective view of the insert of FIG. 46, with products being placed inside the insert.
Figure 48:
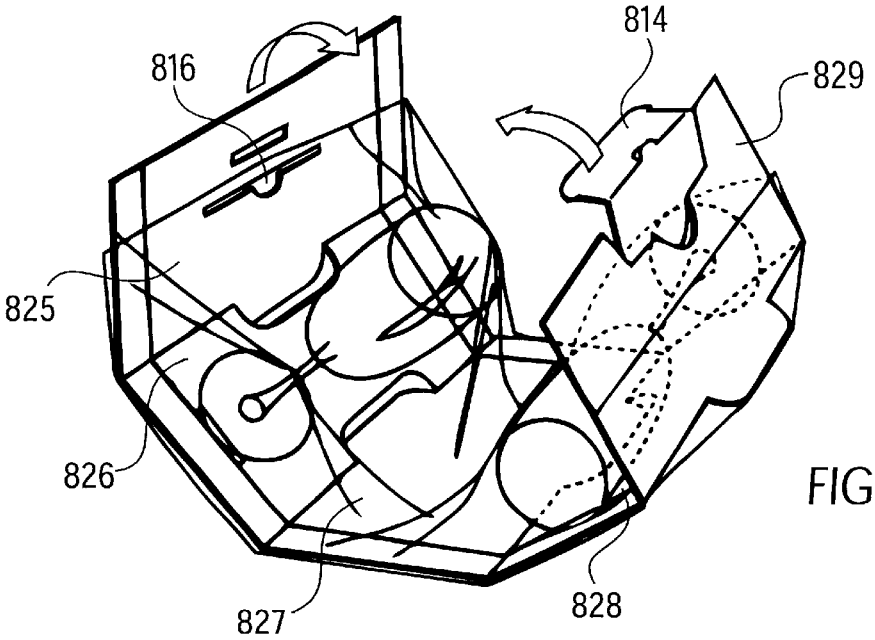
FIG. 48 shows a top perspective view of the insert of FIG. 46, with the base panels being folded.

As shown in FIG. 47, folding the side panels upward with respect to the base 820 blouses up the sleeve 812 for accommodation of items. In this illustration, items are shown being placed at sections 826 and 828 of the base. The sections may be provided with cutouts for assisting in retaining the items, such as the cutouts 836 and 838 which may be used for retaining the bases of stemware or the like.

Figure 49:
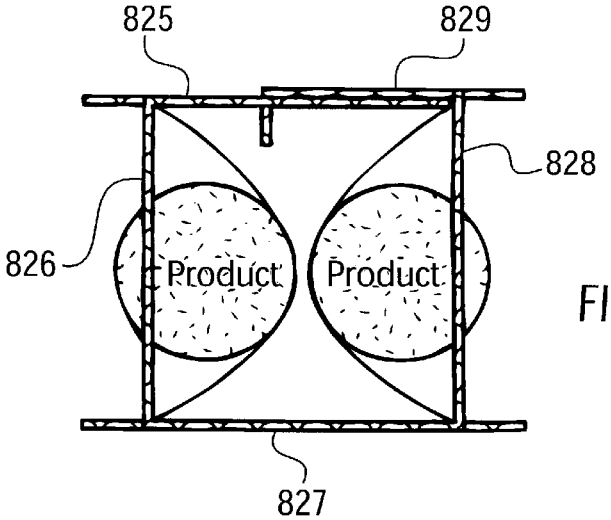
FIG. 49 shows a side view of the insert of FIG. 46, fully folded.
Figure 50:
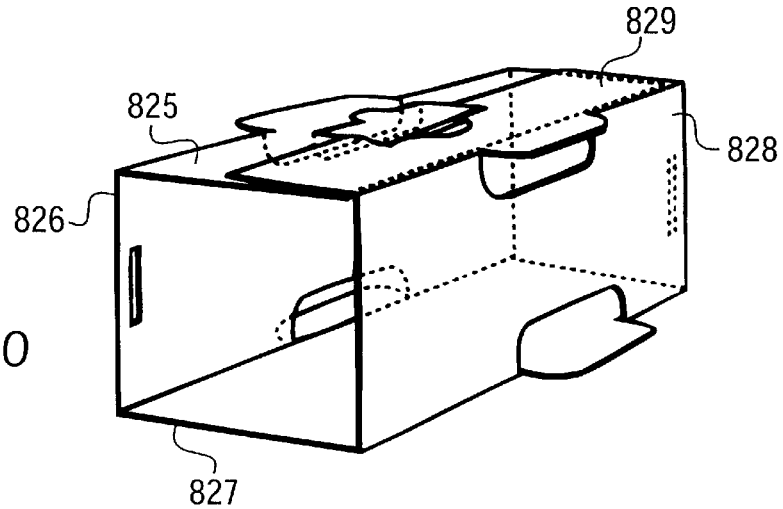
FIG. 50 shows a top perspective view of the insert of FIG. 46, fully folded.
Figure 51:
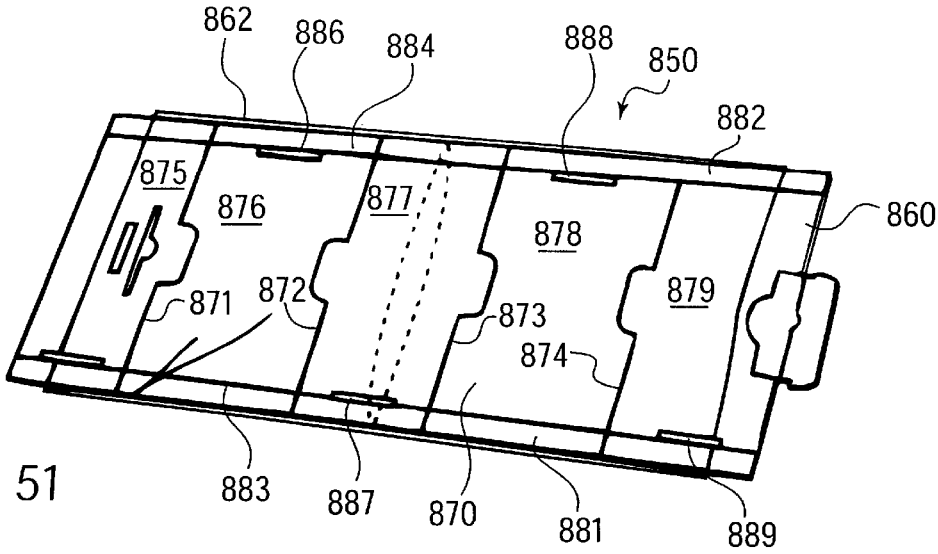
FIG. 51 shows a top perspective view of an insert in accordance with another embodiment of the invention.

Once the products are in place, the base panel 820 is folded along fold lines 821–824 to form an enclosed periphery, as shown in FIGS. 49 and 50. The folding of the insert tensions the sleeve 812 to hold the products in place. A tab 814 is provided for insertion into slot 816, to secure the insert in its folded position.

In the assembled condition, the products at sections 836 and 838 face each other across the inside of the folded insert. The folded insert may be placed inside a box for shipping.

FIGS. 51 through 55 show an insert 850 similar to the insert 800. The insert 850 comprises a relatively rigid sheet 860 and a resilient element 862 in the form of a sleeve or tube.

The sheet 860 has a base panel 870 divided into sections 875, 876, 877, 878 and 879 by fold lines 871, 872, 873 and 874 that extend across the width of the base panel 870. Two side panels 881 and 882 are provided, foldable with respect to the base panel 870 by fold lines 883 and 884.

Figure 52:
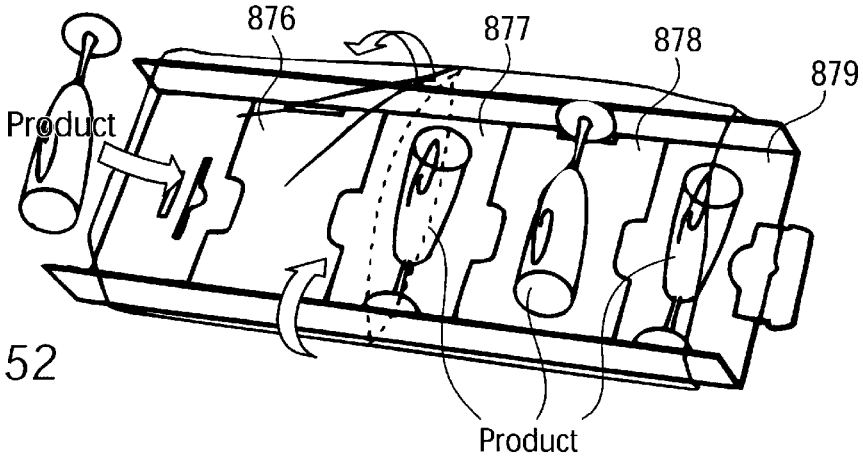
FIG. 52 shows a top perspective view of the insert of FIG. 51, with products being placed inside the insert.
Figure 53:
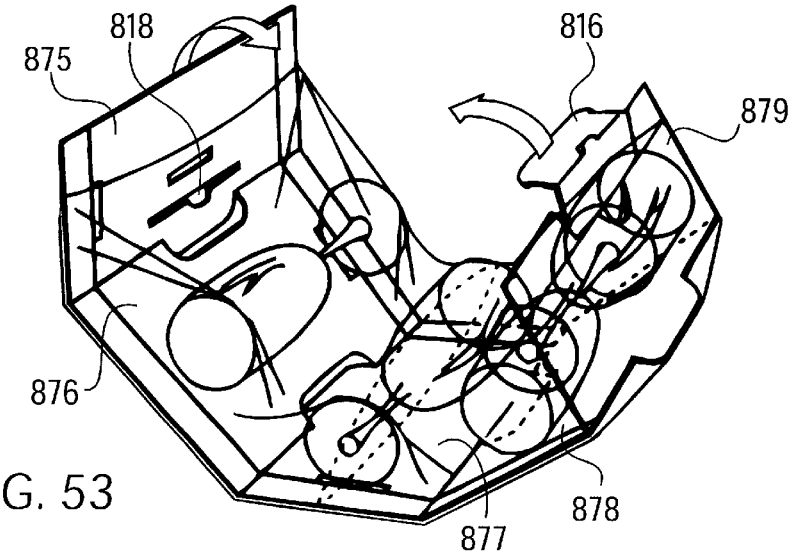
FIG. 53 shows a top perspective view of the insert of FIG. 51, with the base panels being folded.

As shown in FIG. 52, items may be placed at each of sections 876, 877, 878 and 879. As in the insert 800, the sections may be provided with cutouts for assisting in retaining the items, such as the cutouts 886, 887, 888 and 889 which may be used for retaining the bases of stemware or the like.

Figure 54:
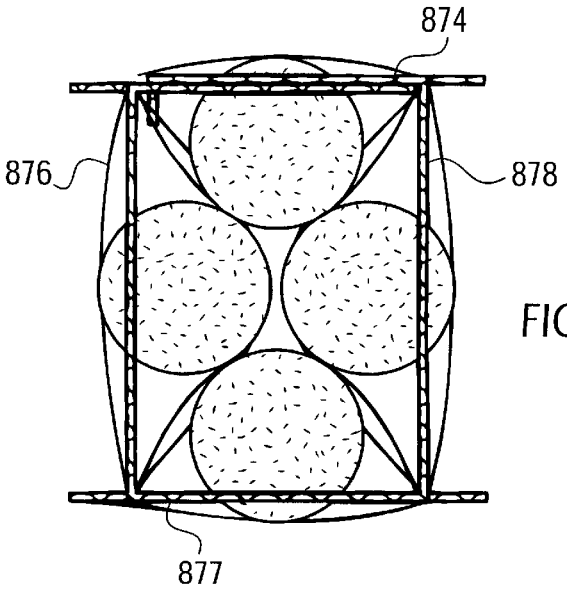
FIG. 54 shows a side view of the insert of FIG. 51, fully folded.
Figure 55:
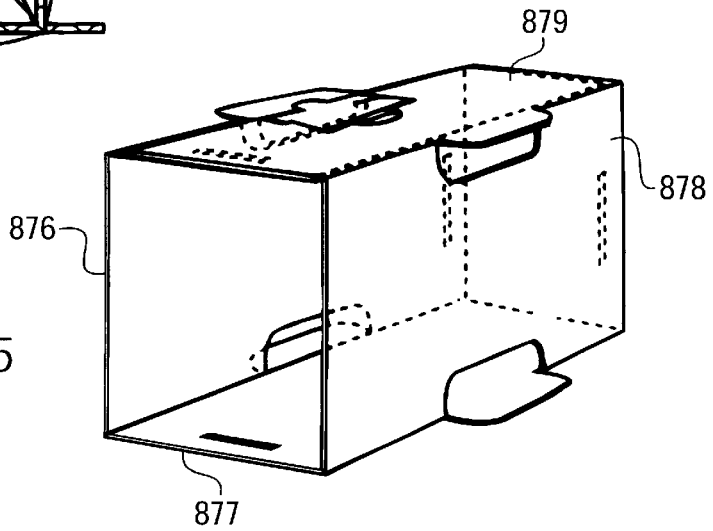
FIG. 55 shows a top perspective view of the insert of FIG. 51, fully folded.

Once the products are in place, the base panel 870 is folded along fold lines 871–874 to form an enclosed periphery, as shown in FIGS. 54 and 55. The folding of the insert tensions the sleeve 862 to hold the products in place. A tab 816 is provided for insertion into slot 818, to secure the insert in its folded position.

FIGS. 56 through 59 show a further embodiment of an insert. The insert 80 comprises a relatively rigid sheet 81 and a resilient element 82 in the form of a sleeve or tube.

The sheet 81 has a base panel 83, two side panels 84 and 85, and two end panels 86 and 87. Fold lines 94 and 95 render the side panels 84 and 85 foldable with respect to the base panel 83. Fold lines 96 and 97 render the two end panels 86 and 87 foldable with respect to the base panel 83.

The sleeve 82 fits around the width of the sheet 81, with the base 83 and side panels 84 and 85 in a flat condition. In this embodiment, the circumference of the sleeve 82 is approximately twice as great as the width of the sheet 81, or slightly more or slightly less. In this manner, the sleeve 82 fits snugly around the sheet 81 when the sheet 81 is flat.

Figure 56:
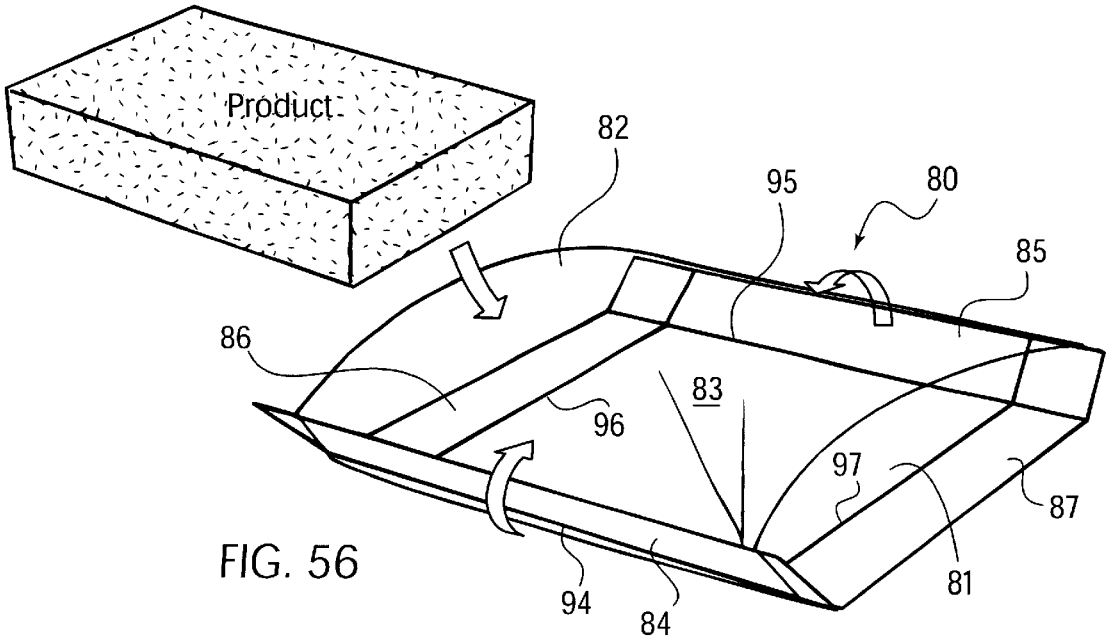
FIG. 56 shows an insert in accordance with another embodiment of the invention, with side panels folded for accommodation of a product.
Figure 57:
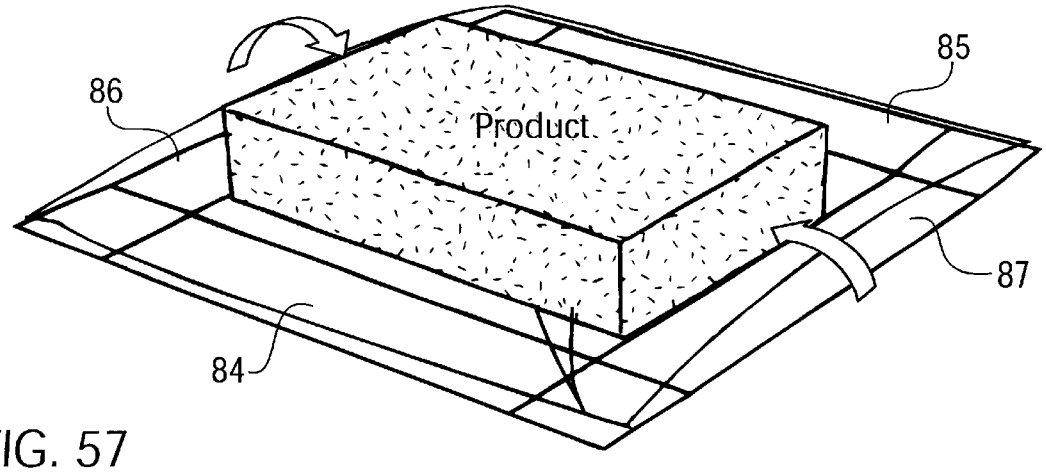
FIG. 57 shows a top perspective view of the insert of FIG. 56, with the side panels returned flat and with the end panels being folded.

To accommodate an item in the insert, the sheet 81 is folded at one or both of the fold lines 94, 95. This blouses up the sleeve 82, to allow for an item to be placed in the sleeve 12, as shown in FIG. 56.

Figure 58:
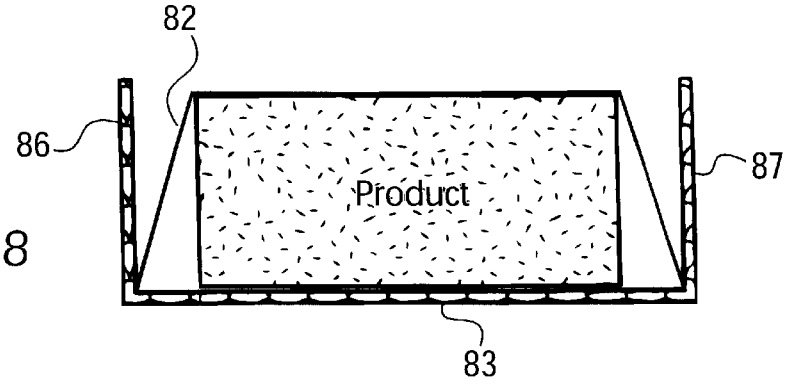
FIG. 58 shows a side view of the insert of FIG. 56, with the end panels folded.
Figure 59:
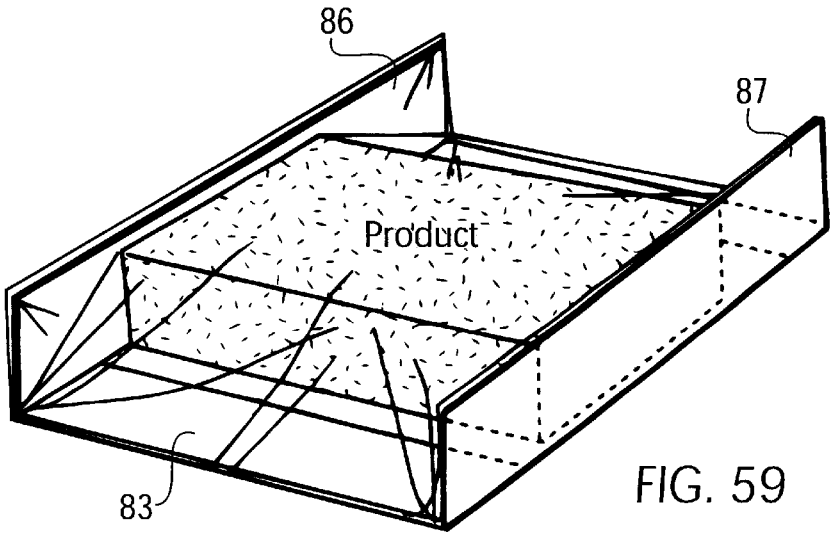
FIG. 59 shows a top perspective view of the insert of FIG. 56, with the end panels folded.

Once the product is placed within the sleeve 82, the side panels 84, 85 are returned flat. This tensions the film 82 around the product, to hold the product securely against the sheet 81. Then, as shown in FIG. 58, the end panels 86 and 87 are folded upward. In this embodiment, the sleeve 82 is longer than the base panel 83 and extends over both of the end panels 86 and 87. Because of this configuration, the folding of the end panels 86 and 87 further tensions the sleeve 82.

When a tall product is packaged in the insert, or a series of objects are stacked creating substantial height, the tension of the sleeve 82 will cause the side panels 84, 85 to be pulled up. Thus creates a cup or tray effect, providing sides to prevent sliding of, and to further secure, the products being shipped.

It will be appreciated that various modifications can be made to the above embodiments without departing from the scope of the invention. While the above description provides various alternative constructions, the scope of the invention is defined by the appended claims.

What is claimed is:

1. A packaging insert for securing one or more objects, the insert comprising:

a relatively rigid sheet of material, comprising at least one base panel and at least a first end panel and a second end panel; and a resilient sleeve surrounding said relatively rigid sheet of material;

wherein the relatively rigid sheet further comprises a first end panel fold line and a second end panel fold line such that the first end panel is foldable relative to the base panel about the first end panel fold line and the second end panel is foldable relative to the base panel about the second end panel fold line;

wherein the relatively rigid sheet further comprises at least one recess-forming fold line extending across the base panel; and wherein the insert has an assembled condition in which the first end panel is folded relative to the base panel about the first end panel fold line and the second end panel is folded relative to the base panel about the second end panel fold line and in which the base panel is folded about said at least one recess-forming fold line to form a recess in the base panel.

2. A packaging insert as claimed in claim 1, wherein said at least one recess-forming fold line also extends across the first end panel and the second end panel, and wherein, in said assembled condition, each of said first end panel and said second end panel is folded about said at least one recess-forming fold line to form spacers.

3. A packaging insert as claimed in claim 1, wherein each of said first end panel and said second end panel comprises leg portions and wherein, in said assembled condition, the leg portions extend below the at least one base panel.

4. A packaging insert as claimed in claim 1, wherein the relatively rigid sheet comprises at least one lateral fold line extending across the at least one base panel and the first and second end panels.

5. A packaging insert as claimed in claim 1, wherein the relatively rigid sheet comprises at least two lateral fold lines extending across the at least one base panel and the first and second end panels.

* * * * *